US005544361A

United States Patent [19]

Fine et al.

[11] Patent Number: 5,544,361

[45] Date of Patent: Aug. 13, 1996

[54] HEADGEAR MOUNTABLE PROTECTIVE FACE SHIELD

[75] Inventors: Wendy J. Fine, Coral Springs, Fla.; Gary A. Davidson, 6985 N.W. 29th Ter., Fort Lauderdale, Fla. 33309; Alexander Rykman, 6285 Island Way, Margate, Fla. 33063

[73] Assignees: Gary A. Davidson, Fort Lauderdale; Alexander Rykman, Margate, both of Fla.

[21] Appl. No.: 374,886

[22] Filed: Jan. 19, 1995

[51] Int. Cl.[6] ..... A42B 1/06; G02C 7/16

[52] U.S. Cl. ..... 2/10; 2/454; 351/57; 351/155

[58] Field of Search ..... 2/424, 15, 10, 2/11, 12, 13, 9, 454, 453; 351/155, 158, 57, 58, 59

[56] References Cited

U.S. PATENT DOCUMENTS

| | | | |
|---|---|---|---|
| 1,176,313 | 3/1916 | Pfund . | |
| 1,238,154 | 8/1917 | Kemp . | |
| 1,298,223 | 3/1919 | Kemp . | |
| 2,360,482 | 10/1944 | Evans | 2/12 |
| 3,030,628 | 4/1962 | Crosson . | |
| 3,521,629 | 7/1970 | Reynolds . | |
| 3,780,379 | 12/1973 | Kampman | 2/15 |
| 3,868,727 | 3/1975 | Paschall | 2/8 |
| 4,726,074 | 2/1988 | Baclit et al. | 2/10 |
| 4,758,079 | 7/1988 | Bledsoe | 351/44 |
| 4,870,959 | 10/1989 | Reisman et al. | 128/201.25 |
| 5,066,082 | 11/1991 | Longstaff | 359/361 |
| 5,105,475 | 4/1992 | Lynd et al. | 2/10 |
| 5,113,535 | 5/1992 | Hedges et al. | 2/424 |
| 5,208,916 | 5/1993 | Kelman | 2/10 |
| 5,261,124 | 11/1993 | Day | 2/453 |
| 5,329,642 | 7/1994 | Dampney | 2/424 |

FOREIGN PATENT DOCUMENTS

| | | | |
|---|---|---|---|
| 2532528 | 3/1984 | France | 2/424 |
| 1299559 | 3/1987 | U.S.S.R. | 2/424 |

OTHER PUBLICATIONS

Bolle America, Inc., "Sun and Sport Eyewear Buyer's Guide 1994" ( cover and page 7).

Council on Scientific Affairs, "Harmful Effects of Ultraviolet Radiation", JAMA, Jul. 21, 1989–vol. 262, No. 3.

Boyce Rensberger, "Ultraviolet Spectrum's Long Rays May Cause Malignant Melanoma", Washington Post, Jul. 23, 1993, p. 15.

National Institute of Arthritis and Musculoskeletal and Skin Diseases, "Sun and Skin" Jul. 1992.

National Institutes of Health, "Sunlight, Ultraviolet Radiation and the Skin", Consensus Development Conference Statement, vol. 7, No. 8, May 8–10, 1989.

*Primary Examiner*—Michael A. Neas

*Attorney, Agent, or Firm*—Mallinckrodt & Mallinckrodt

[57] ABSTRACT

The present invention provides a lightweight headgear mountable protective face shield capable of protecting substantially the entire face of a human wearer from ultraviolet radiation. The face shield comprises an articulated shielding arrangement to be positioned in blocking relationship to the wearer's face. The shielding arrangement comprising a plurality of segments extending across the wearer's face, the ends of which are preferably pivotally connected to hinge plates positioned at either side of the wearer's head. The hinge plates are attached to a securing mechanism which secures the face shield to an article of headgear. In a preferred embodiment, the face shield is detachably secured to the forwardly projecting bill of a baseball style cap by a securing mechanism comprising a pair of jaws between which the bill is secured by clamping.

18 Claims, 14 Drawing Sheets

HEADGEAR MOUNTABLE PROTECTIVE FACE SHIELD

FIELD OF THE INVENTION

This invention relates to a protective face shield for mounting on an article of headgear, or which forms an integral part of an article of headgear, for protecting the face of a human wearer from exposure to ultraviolet radiation.

BACKGROUND OF THE INVENTION

There are both natural and artificial sources of ultraviolet (UV) radiation. Although there are many artificial sources of UV radiation, such as tanning lamps and welding arcs, sunlight is the only natural source.

Two types of UV radiation emitted by the sun reach the surface of the earth. These are known as ultraviolet B (UVB), which has wavelengths from about 290 to about 320 nm, and ultraviolet A (UVA), which has wavelengths from about 320 to about 400 nm.

Both UVA and UVB radiation can have damaging effects on human skin, such as sunburn, heatstroke, skin aging and skin cancer. Until now, substantially the only method for protecting human skin from the effects of UV radiation has been to cover the skin with clothing or to use physical or chemical sunscreening products, in the forms of creams and oils.

However, creams and oils applied to the skin can impair perspiration, clog pores causing acne and may be uncomfortable to the user. Creams and oils also constitute a permanent, recurring cost to the user. Further, these creams and oils can be removed from the skin, as by wiping off through physical contact or by washing off by the action of perspiration or water. This may be done without the awareness of the user, leaving the skin unprotected.

The face is a particularly important area to protect, since facial skin may be more sensitive than skin on other parts of the body, and is difficult to protect because it cannot typically be covered by protective clothing. Because it is typically not covered, the face may receive larger doses of UV radiation than other parts of the body.

The only known facial UV protectors which are not applied directly to the skin are eye protectors, such as sunglasses, welding goggles and shields. However, sunglasses cover only a portion of the face and other known devices are typically intended for specialized uses such as in welding.

Therefore, the disadvantage exists that no UV protective products are currently available for use by the general public, other than sunscreening creams and oils, which substantially completely cover the human face and protect it from UV radiation.

SUMMARY OF THE INVENTION

To at least partially overcome the disadvantages of previously known products for protecting the human face from ultraviolet radiation, the present invention provides a protective face shield which may conveniently be mounted on an article of headgear or which may form an integral part of an article of headgear and which can protect substantially the entire face of a human wearer from the effects of UV radiation.

The inventor has developed a headgear mountable protective face shield which is preferably mountable from the brim or bill of an article of headgear, such as a baseball style cap. The face shield is also mountable on other types of headgear, such as eyeglasses, including sunglasses. The face shield preferably has a segmented, transparent face shielding portion positioned forwardly of the wearer's face and which preferably covers substantially the entire face, thereby protecting the face from UV radiation.

It is one object of the present invention to provide a headgear mountable protective face shield to protect a wearer's face from UV radiation.

It is another object of the present invention to provide a protective face shield which may be detachably mounted on an article of headgear.

In one of its aspects, the present invention provides a headgear mountable protective face shield to substantially completely cover a wearer's face and protect the face from exposure to UV radiation. The shielding device preferably prevents most UV radiation from reaching the face of the wearer.

The face shield has an articulated shielding device comprising a plurality of curved elongated segments, each segment extending across the wearer's face and having a first end secured to a first hinge mechanism and a second end secured to a second hinge mechanism.

The first hinge mechanism is to be positioned outwardly of a first side of the wearer's head, and the second hinge mechanism is to be positioned outwardly of a second side of the wearer's head. At least one of the segments of the shielding device is pivotable about a pivot axis extending through the first and second hinge mechanisms.

The shielding device preferably comprises three segments: an upper segment, a middle segment, and a lower segment. The upper segment is preferably in frontal blocking relationship to the eyes of the wearer. The middle and lower segments are preferably independently pivotable about the pivot axis, and can preferably adopt positions from a retracted position wherein they nest with the upper segment and are in frontal blocking relationship to the eyes of the wearer, to an extended position wherein they individually protect portions of the face from UV radiation.

Preferably, the upper segment is at least partially transmissive of visible radiation. Therefore, the upper segment is preferably transparent to visible light. More preferably, both the middle and lower segments are also transparent to visible light.

To increase the comfort of the wearer, at least the upper segment of the shielding device is provided with ventilation holes. These holes are preferably provided proximate the ends of the segment and preferably in the upper portion of the segment to not interfere with the wearer's vision. The middle and lower segments may also be provided with similar ventilation holes.

The face shield also comprises a securing mechanism to secure the hinge mechanism to an article of headgear to be worn by the wearer. Preferably, a securing mechanism is provided which detachably secures the hinge mechanism to an article of headgear. More preferably, the securing mechanism secures the face shield to an outwardly projecting brim of an article of headgear, the brim having an upper surface and a lower surface. The securing mechanism preferably comprises an upper jaw which engages the upper surface of the brim and a lower jaw which engages the lower surface of the brim. The upper and lower jaws are preferably biased together, the brim of the headgear being retained between the upper and lower jaws. The hinge means to which the segments of the shielding device are attached is preferably carried by the lower jaw of the securing mechanism.

Most preferably, the securing mechanism secures the face shield to a bill which forms part of an article of headgear and which projects forwardly of the user's head, the bill having an upper surface, a lower surface, and an outer periphery. The securing mechanism preferably comprises an upper jaw which engages the outer periphery on the upper surface of the bill and a lower jaw to engage the outer periphery on the lower surface of the bill. The upper and lower jaws are preferably biased together, thereby retaining the bill between the upper and lower jaws.

The upper and lower jaws are preferably U-shaped, each having two rearwardly projecting ends joined by a forwardly projecting, curved portion having a forward edge, the hinge means being carried on the rearward ends of the jaw.

In order to open and close the upper and lower jaws and to bias them together, the upper and lower jaws are preferably pivotable about a substantially horizontal axis proximate their forward edges. To further improve retention of the bill between the jaws, clamping means are preferably provided adjacent the rearward edges of the jaws to bias the upper and lower jaws together.

To prevent the upper segment of the shielding device from being displaced relative to the wearer's eyes, the upper segment is preferably secured to the under side of the brim or bill of the headgear. In one preferred embodiment, the upper segment has an upper edge detachably secured to the lower jaw adjacent the forward edge of the lower jaw. Therefore, the upper segment is prevented from pivoting about the pivot axis while it is secured to the lower jaw. However, when detached from the lower jaw, the upper segment is preferably independently pivotable about the pivot axis.

The face shield of the present invention is capable of providing UV protection as effective, or more effective, than previously known products. Preferably, the shielding device provides a sun protection factor of from about 15 to about 100, more preferably from about 50 to about 100, and most preferably from about 90 to about 100.

The shielding device preferably comprises a base made from a flexible plastic such as polycarbonate or acrylic, polycarbonates being more preferred. The base contains additives which absorb and/or reflect UV radiation, the shielding device having a thickness of about 0.1 mm to about 2.0 mm. Therefore, each segment comprises a thin layer of plastic containing ultraviolet absorbing and/or reflecting additives and having thickness of from about 0.1 mm to about 2.0 mm.

BRIEF DESCRIPTION OF THE DRAWINGS

Further aspects and advantages of the present invention will become apparent from the following description, taken together with the accompanying drawings, in which.

DETAILED DESCRIPTION OF THE PREFERRED EMBODIMENTS

A first preferred embodiment of the headgear mountable protective face shield is now described with reference to FIGS. 1 to 6.

Figure 1:
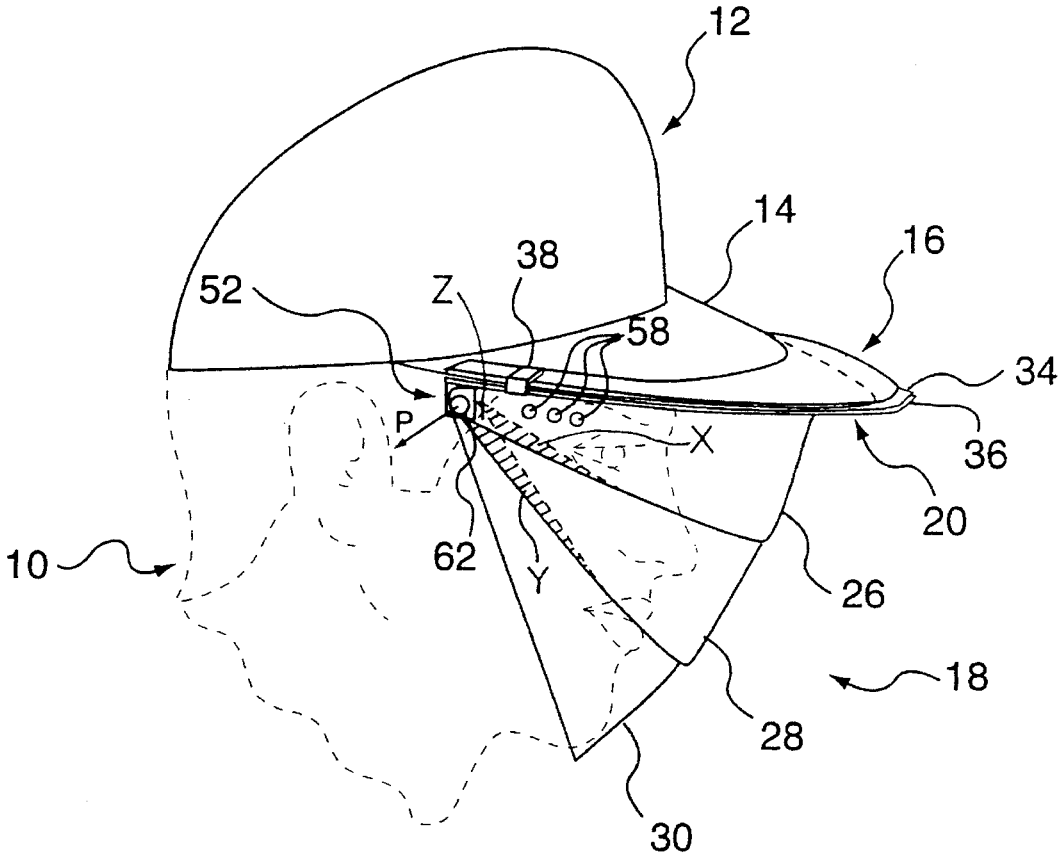
FIG. 1 is a side perspective view illustrating a headgear mountable protective face shield according to a preferred embodiment of the present invention as worn by a human wearer.

FIG. 1 illustrates a person 10 wearing a baseball style cap 12 having a forwardly projecting, rounded bill 14. Attached to bill 14 is a headgear mountable protective face shield 16 according to the present invention comprising a shielding device 18 and a securing mechanism 20. The face shield 16 is releasably secured to the bill 14 of cap 12 by securing mechanism 20.

The securing mechanism 20 preferably comprises a flat, U-shaped upper jaw 22 and a corresponding flat, U-shaped lower jaw 24, between which the edges of bill 14 of cap 12 is clamped.

Figure 2:
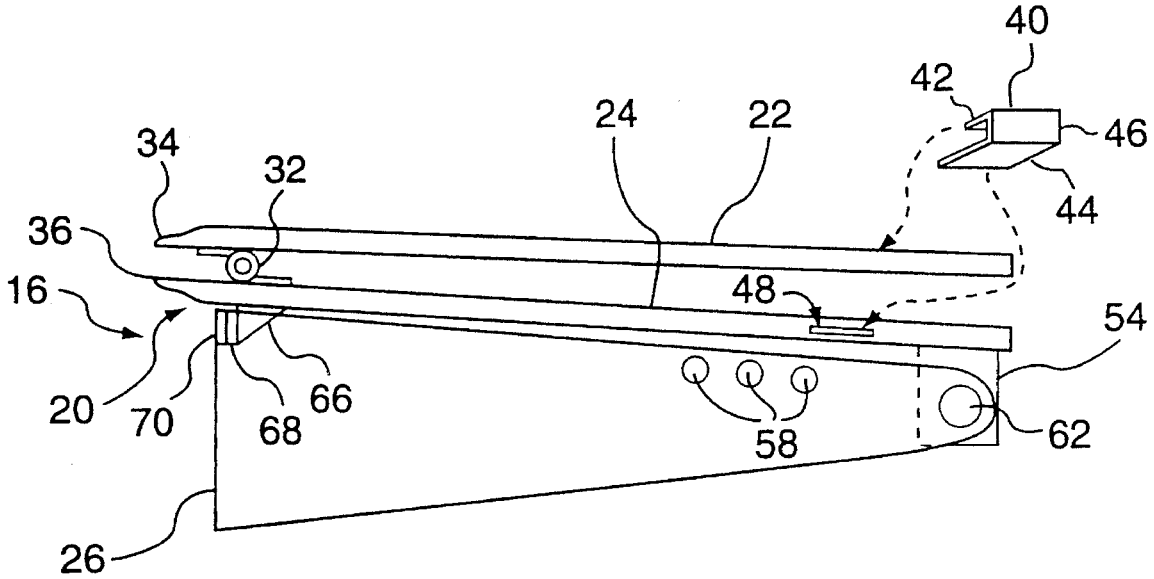
FIG. 2 is a side view illustrating the face shield shown in FIG. 1, omitting the middle and lower segments.
Figure 3:
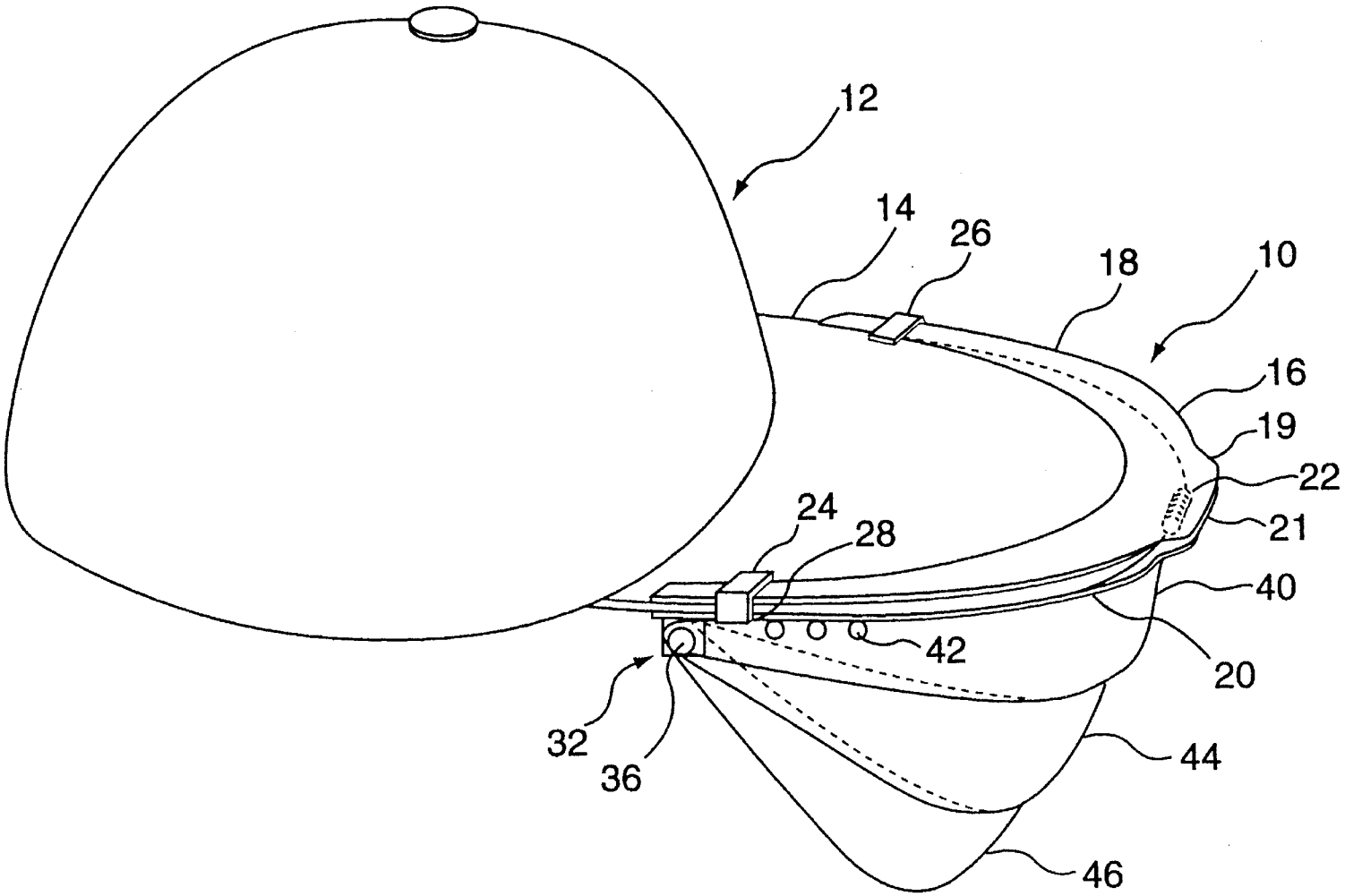
FIG. 3 is a side perspective view illustrating the face shield of FIG. 1 mounted on an article of headgear.

As shown in FIG. 1, the shielding device 18 is preferably articulated and comprises a plurality of curved, elongated segments. FIG. 1 to 3 illustrate a particularly preferred articulated shielding device 18 comprising three individual segments; an upper segment 26, a middle segment 28, and a lower segment 30. For convenience, only upper segment 26 is shown in FIG. 2. It is to be understood that face shield 16 shown in FIG. 2 is identical to that shown in FIGS. 1 to 3.

The shielding device 18 preferably substantially completely covers the face of wearer 10 and preferably prevents most UV radiation from reaching the wearer's face, thus protecting substantially the entire face of wearer 10 from UV radiation. Preferably, at least the upper segment 26 of shielding device 18 is partially transmissive of visible radiation and is therefore transparent to the wearer 10. More preferably, all three segments 26, 28 and 30 are transparent.

The securing mechanism 20 of the first preferred embodiment is now described in detail.

The U-shaped jaws 22 and 24 of securing mechanism 20 are preferably pivotally secured together adjacent their forward edges, preferably by a torsion spring 32 located in between upper and lower jaws 22 and 24, which is best illustrated in FIG. 2. The upper and lower jaws 22 and 24 pivot about torsion spring 32, with torsion spring 32 exerting a biasing force which forces the jaws 22 and 24 to close.

To assist in opening the jaws 22 and 24, finger tabs 34 and 36 are preferably provided at forward edges of jaws 22 and 24, respectively. The tabs 34 and 36 are preferably gripped between two fingers of one hand by wearer 10 and pressed together to overcome the biasing force of spring 32, thereby pushing the finger tabs 34 and 36 closer together and opening the jaws 22 and 24. The jaws 22 and 24 are preferably made from thin, light weight, flexible plastic, to minimize the bulk and weight of face shield 16.

FIGS. 1 and 3 illustrate a preferred manner in which the face shield 16 is secured to the bill 14 of cap 12. The jaws 22 and 24 are first opened by pressing tabs 34 and 36 as discussed above. The bill 14 of cap 12 is then inserted between opened jaws 22 and 24 so that the outer edges of the bill 14 are positioned between jaws 22 and 24. The jaws 22 and 24 are then allowed to close, the biasing force of spring 32 pressing the upper jaw 22 against the upper surface of bill 14 and pressing lower jaw 24 against the lower surface of bill 14, thereby retaining bill 14 between jaws 22 and 24.

Although securing mechanism 20 is illustrated as having jaws 22 and 24 pivotable about their forward edges, this is not necessarily the case. The jaws may also be pivotable about their rearward ends, in which case, two pivoting mechanisms are preferably provided.

To more firmly secure bill 14 between jaws 22 and 24, left retaining clip 38 and right retaining clip 40 (shown in FIGS. 2 and 3) are preferably provided adjacent the rearward ends of jaws 22 and 24, thus holding jaws 22 and 24 together adjacent their rearward ends. Retaining clips 38 and 40 are preferably made from thin, U-shaped pieces of metal or plastic.

FIG. 2 illustrates clip 40 as comprising substantially parallel upper arm 42 and lower arm 44 connected by a central bight 46. As shown by the dotted arrows in FIG. 2, lower arm 44 is preferably received in slot 48 in the side of lower jaw 24 and upper arm 42 preferably engages the upper surface of upper jaw 22. Preferably, bight 46 is sized so that when bill 14 is sandwiched between jaws 22 and 24, clip 40 forces jaws 22 and 24 more tightly together, firmly securing bill 14.

Although not shown by the drawings, upper arm 42 may also be received in a slot, similar to slot 48, in upper jaw 22. Further, lower arm 44 could engage the underside of lower jaw 24 instead of being received in slot 48.

Figure 4A:
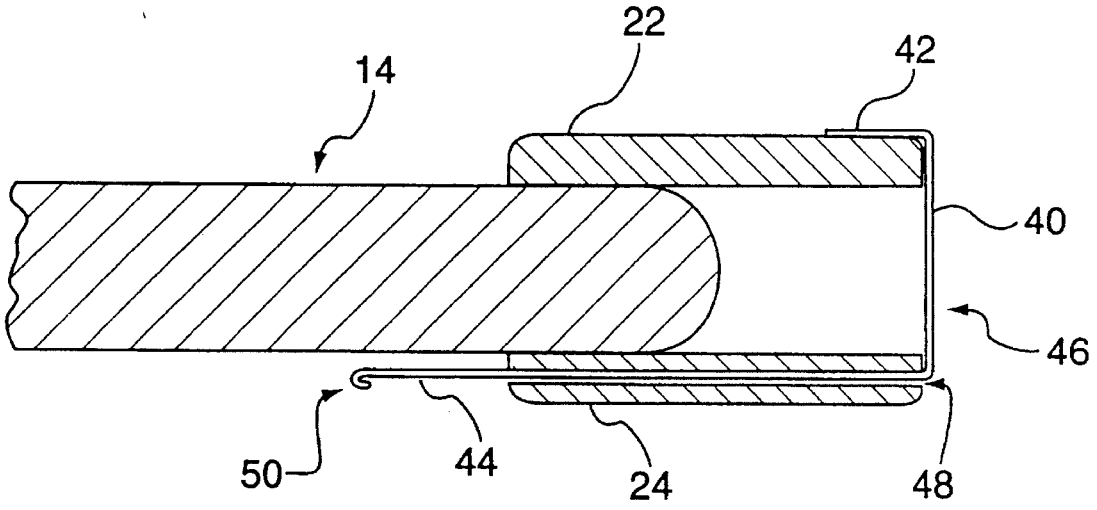
FIG. 4A is a cross-sectional side view illustrating a preferred clamping mechanism according to the present invention in the engaged position.
Figure 4B:
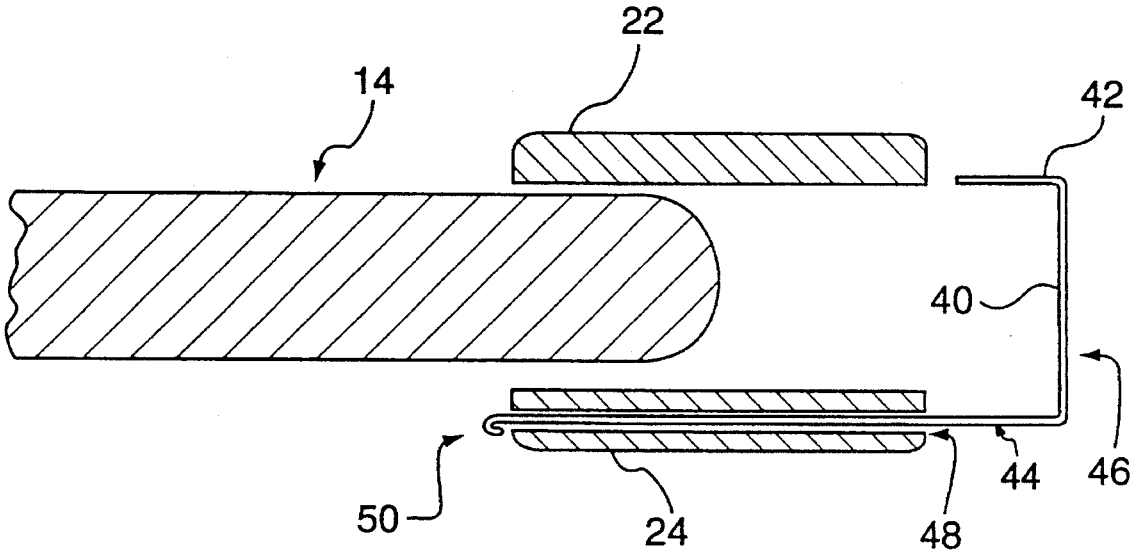
FIG. 4B is a cross-sectional side view illustrating the preferred clamping mechanism shown in FIG. 4A in the disengaged position.

FIGS. 4A and 4B, representing cross-sectional views through the rearward ends of jaws 22 and 24 at slot 48, show a particularly preferred retaining clip 40. Clip 40 has an upper arm 42 which is shorter than lower arm 44, lower arm 44 having an enlarged end 50 which cannot be pushed through slot 48.

FIG. 4A shows clip 40 in the engaged position, with longer lower arm 44 extending through slot 48 in lower jaw 24, and shorter upper arm 42 engaging the upper surface of upper jaw 22. With clip 40 engaged, bill 14 is firmly retained between jaws 22 and 24.

If clip 40 is pushed so that it moves to the right in FIG. 4A, it will become disengaged when shorter upper arm 42 is pushed out of engagement with the upper surface of upper jaw 22. FIG. 4B illustrates clip 40 after it has been pushed out of engagement, with upper arm 42 having become disengaged from the upper surface of upper jaw 22.

FIG. 4B shows that, because enlarged end 50 will not fit into slot 48, lower arm 44 remains retained in slot 48 of lower jaw 24, even though clip 40 is no longer holding jaws 22 and 24 together. The configuration of clip 40 shown in FIGS. 4A and 4B is preferred because clip 40 always remains attached to the securing mechanism 20, and cannot be lost when the face shield 16 is removed from the bill 14 of cap 12.

Attached to and extending downwardly from the rearward ends of lower jaw 24 are right hinge plate 52 and left hinge plate 54. These hinge plates 52 and 54 are preferably rigidly secured to lower jaw 24 and are preferably not movable relative to lower jaw 24. Hinge plates 52 and 54 may be integrally formed as part of lower jaw 24, or may be rigidly secured to lower jaw 24 by means of adhesive and/or fasteners. As shown in the exploded, enlarged view of FIG. 5, right hinge plate 52 is provided with a central hole 56. Left hinge plate 54 (shown in FIG. 2) is provided with an identical central hole 56.

The following is a detailed description of shielding device 18. Preferably, shielding device 18 at least partially reflects and/or absorbs electromagnetic radiation having wavelengths from about 250 nm to about 410 nm. More preferably, the shielding device 18 at least partially reflects and/or absorbs electromagnetic radiation having wavelengths from about 290 nm to about 400 nm, which is the approximate range of wavelengths of ultraviolet radiation emitted by the sun which reaches the earth's surface.

Most preferably, the shielding device 18 is capable of reflecting and/or absorbing at least about 99% of ultraviolet radiation having wavelengths from about 290 nm to about 390 nm. This level of reflectiveness and/or absorption is equivalent to a "sun protection factor" (SPF) of 100.

The SPF of the shielding device 18 is at least partially dependent upon its composition and its thickness. Preferably, the shielding device 18 comprises a base made from a thin, flexible plastic such as polycarbonate or acrylic. Preferably, the base incorporates one or more additives which reflect and/or absorb UV radiation. The additives are preferably present in the base in an amount of about 0.01 to about 1.0% by weight.

One particularly preferred base material is Polycarbonate 2658. Preferred additives may be selected from the group comprising TINUVIN* P, TINUVIN* 327, TINUVIN* 328, TINUVIN* 770, B 225 IRGANOX*, PEP Q SANDOSTAB*, CYASORB* UV 5411, DISPERSAL*, G62 PARAPLEX*, UVAROL P*, UVAROL* 236, UVAROL* 311 and A280* wax. However, it is to be understood that many other known additives may *Trade mark be used to enhance the properties of the shielding device of the present invention.

One example of a particularly preferred polycarbonate based shielding composition is as follows:

Polycarbonate 2658 base

B 225 IRGANOX: 0.1 weight %

PEP-Q SANDOSTAB: 0.1%

G62 PARAPLEX: 0.15 weight %

TINUVIN P: 0.3 weight %

TINUVIN 328: 0.3 weight %

TINUVIN 770: 0.2 weight %

A 1.0 mm thick layer of the above composition is capable of blocking 99.5% about of electromagnetic radiation having a wavelength from 290 to 400 nm, which is equivalent to a SPF of 100.

A shielding device 18 having the same composition as above but a thickness of 0.30 mm is capable of blocking 97% of radiation having a wavelength between 290 and 390 nm, giving an SPF of 35.

Preferably, the shielding device 18 has an SPF of between 15 and 100, translating to reflection and/or absorbance of between 93.33% to over 99% of light having a wavelength between 290 and 390 nm. Preferably, the thickness of the segments comprising the shielding device 18 is from about 0.1 to about 2.0 mm.

Because upper segment 26 is in frontal blocking relationship to the eyes of the user, it is at least partially transmissive of visible radiation, which has wavelengths in the range from about 400 nm to about 700 nm. Therefore, at least the upper segment 26 is transparent. The upper segment 26 is preferably tinted, for example by addition of colourants which reduce the total transmission of visible light, to reduce glare from the sun to the eyes of wearer 10.

More preferably, all three segments 26, 28 and 30 are at least partially transmissive of visible radiation. The middle and lower segments 28 and 30 may also preferably be tinted to reduce glare from the sun.

Figure 6:
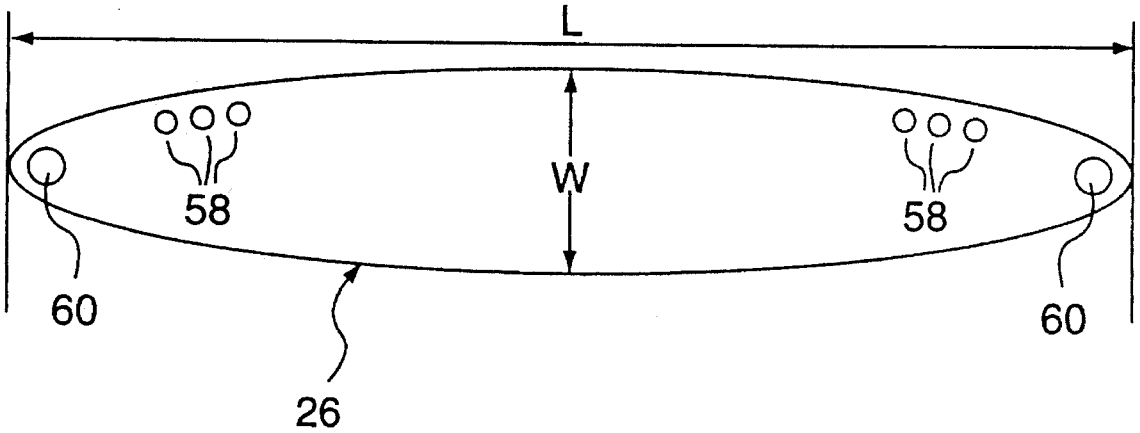
FIG. 6 is a top plan view illustrating the upper segment of the face shield of FIG. 1, having been removed from the face shield.

FIG. 6 illustrates upper segment 26, flattened and in isolation from face shield 16. Segment 26 is preferably wider near its centre and narrower near its ends. Preferably, segment 26 has a width W of from about 1 to about 4 inches, more preferably from about 2 to about 3 inches.

As shown in FIG. 6, upper segment 26 is preferably provided with ventilation holes 58 to improve the comfort of the wearer 10. Ventilation holes 58 are preferably provided adjacent the ends of segment 26 and near the top of segment 26 so as not to impair the vision of wearer 10.

Segment 26 is provided with two end holes 60, one located at either end of segment 26. When assembled as part of face shield 16, the holes 60 in segment 26 register with holes 56 in the hinge plates 52 and 54. Segment 26 preferably has a length L and flexibility sufficient that when holes 60 in segment 26 register with holes 56 in hinge plates 52 and 54, segment 26 bends and curves in an arc large enough to curve around the front of the face of wearer 10.

Figure 5:
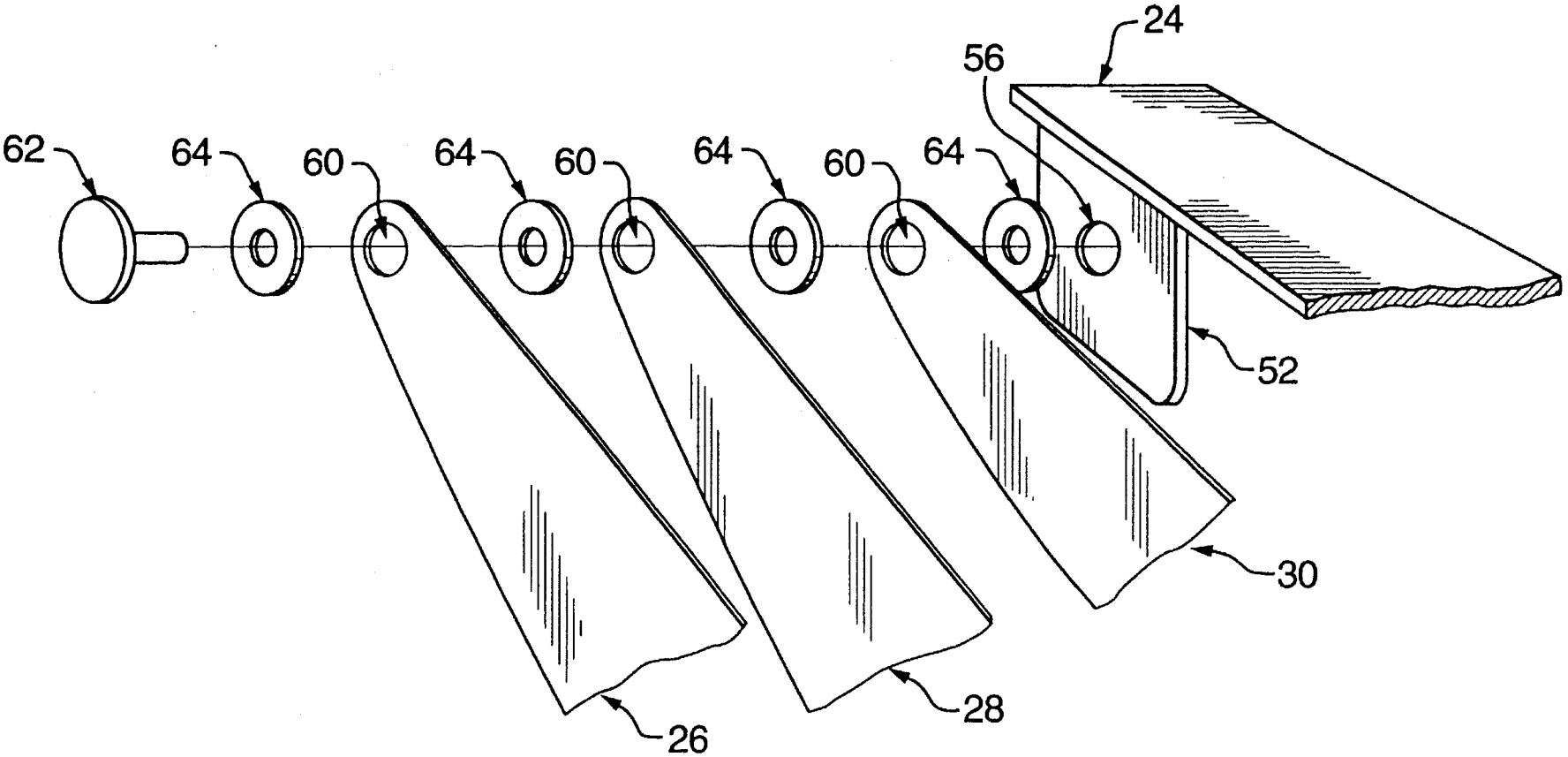
FIG. 5 is an exploded, perspective view, partially in cross-section, illustrating the positioning of the segments of the shielding device of FIGS. 1 to 3 about the right hinge plate.

Middle segment 28 and lower segment 30 are preferably similar in size and shape to upper segment 26 shown in FIG. 5, and have identical holes 60. Segments 28 and 30 may also be provided with ventilation holes similar to holes 58 of upper segment 26, preferably adjacent their ends, although this is not shown in the drawings.

The exploded view of FIG. 5 illustrates one preferred form of attachment of segments 26, 28 and 30 to right hinge plate 52. Although not discussed below, the method of attachment of segments 26, 28 and 30 to left hinge plate 54 is preferably identical. The holes 60 of segments 26, 28 an 30 line up with central hole 56 of hinge plate 52. The segments 26, 28 and 30 are secured to hinge plate 52 by a pivot pin 62 which extends through each end hole 60 of segments 26, 28 and 30 and through central hole 56 in hinge plate 52.

The pivot pin 62 may be secured in hole 56 by any known method. For example, the end of pivot pin 62 may be enlarged after insertion through hole 56 or pivot pin 62 may be threaded and provided with a nut to retain it in hole 56.

It is preferred that the three segments 26, 28 and 30 be independently pivotable about pivot pin 62. Washers 64 are preferably provided between the adjacent segments 26, 28 and 30 as well as between pivot pin 62 and segment 30 and between segment 26 and hinge plate 52, to aid in pivoting.

Alternatively, stop mechanisms may be provided which prevent rotation of middle and lower segments 28 and 30 downward from their positions in FIG. 1. Such stop mechanisms may preferably be in the form of projections on the shaft of pivot pin 62

Preferably, each of the segments 26, 28 and 30 is of a slightly different length, so that when they are secured to hinge plates 52 and 54, they describe a slightly differently sized arc around the face of wearer 10. This allows segments 26, 28 and 30 to be independently pivotable nested one behind the other (as shown in FIG. 8 in relation to a second preferred embodiment).

FIG. 1 illustrates upper segment 26 as being slightly longer than middle segment 28, and middle segment 28 as being slightly longer than lower segment 30. Therefore, the ends of segments 26, 28 and 30 must be positioned as shown in FIG. 5, with lower segment 30 closest to hinge plate 52 and upper segment 26 farthest from hinge plate 52.

However, segment 26 may also be the shortest of the three, with lower segment 30 being longer than middle segment 28. In this case, the positions of segments 26 and 30 shown in FIG. 5 are reversed.

Figure 8:
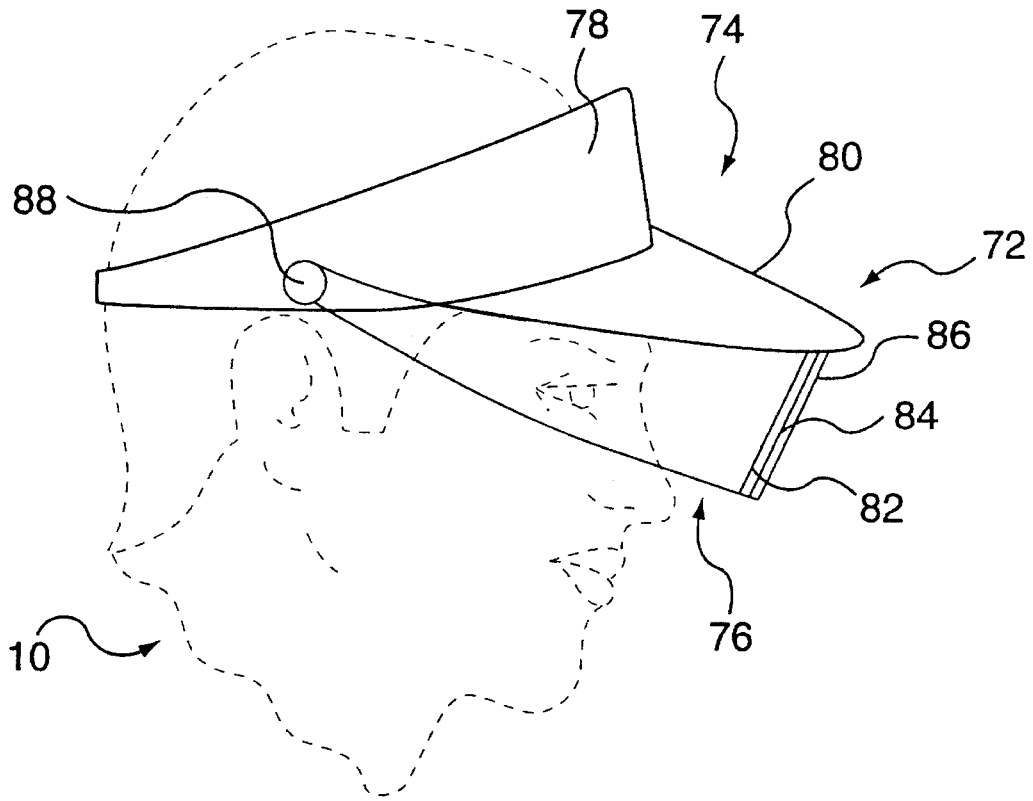
FIG. 8 is a side perspective view illustrating the face shield of FIG. 7 as worn by a human user, with all three segments in frontal blocking relationship to the eyes of the wearer.

Preferably, at least segments 28 and 30 are pivotable about a pivot axis P, extending through pivot pin 62, and are capable of adopting a retracted position wherein middle and lower segments 28 and 30 are nested behind or in front of upper segment 26 (as shown in FIG. 8) and an extended position shown in FIGS. 1 and 2 wherein middle segment 28 is positioned below upper segment 26 and lower segment 30 is positioned below middle segment 28. In the extended position, shielding device 18 substantially completely covers the face of wearer 10, thereby protecting substantially the entire face of wearer 10 from exposure to ultraviolet radiation.

As shown in FIGS. 1 and 3, there is a degree of overlap between segments 26, 28 and 30 at the side of the face of wearer 10. The upper edges of lower segment 30 and middle segment 28 are shown as dotted lines and are underneath upper shield 26.

Shaded area X shown in FIG. 1 is the area of overlap between upper segment 26 and middle segment 28. Shaded area Y is the area of overlap between middle segment 28 and lower segment 30. Unshaded area Z is the area of overlap of all three segments 26, 28 and 30.

Preferably, there is little or substantially no overlap of segments 26, 28 and 30 at the front of the face of wearer 10. Overlap at the front of the face would result in darker bands where there is overlap, thus impairing the vision of wearer 10.

Although upper segment 26 is preferably pivotable about pivot pin 62, it is preferably retained in position and prevented from pivoting about the pivot axis P, the upper edge of segment 26 engaging the lower surface of lower jaw 24.

A particularly preferred way to secure upper segment 26 to lower jaw 24 is shown in FIG. 2. Lower jaw 24 is preferably provided with a lip 66 on its lower surface adjacent the finger tab 36. This lip 66 preferably engages the inside upper edge of upper segment 26. Upper segment 26 may be permanently secured to lower jaw 24 by providing a layer of glue (not shown) between lip 66 and the inside upper edge of upper segment 26.

More preferably, upper segment 26 is releasably secured to lip 66, allowing upper segment 26 to be detached from lower jaw 24 and pivoted about the pivot axis P. A preferred method of attaching upper edge of upper segment 26 and lip 66 is to provide mating strips 68 and 70 of a touch fastener between lip 66 and segment 26. Alternatively, the lip 66 and upper edge of segment 26 may be coated with materials which are attracted magnetically.

A second preferred embodiment of the headgear mountable protective face shield according to the present invention is now described with reference to FIGS. 7 to 9.

Figure 7:
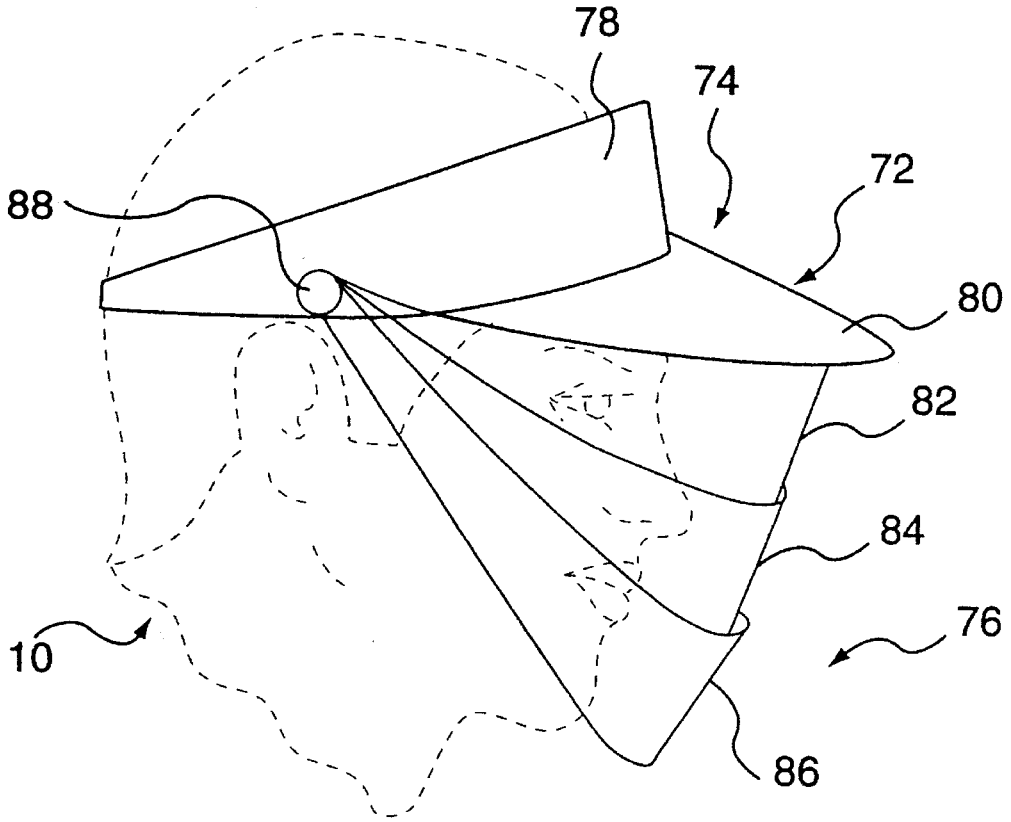
FIG. 7 is a side perspective view illustrating a second preferred embodiment of the face shield of the present invention, with the shielding device extending over the user's face.

FIG. 7 illustrates a human wearer 10 wearing a face shield 72 according to a second embodiment of the present invention comprising a visor 74 and a shielding device 76. The visor 74 comprises a band portion 78 extending around the head of wearer 10 and a bill portion 80 attached to the band 78 and projecting forwardly of the wearer's face. The shielding device 76 is similar to that of the first embodiment, being articulated and comprising upper segment 82, middle segment 84 and lower segment 86. The overlap of segments 82, 84 and 86 is not shown in FIG. 7. However, it is to be understood that they overlap in substantially the same manner as shown in FIG. 1 for segments 26, 28 and 30.

The second embodiment does not utilize a securing mechanism such as the mechanism 20 of the first embodiment. Rather, a pivot pin 88 is secured to each side of the band portion 78 of visor 74. The segments 82, 84 and 86 are preferably secured to the band portion 78 in substantially the same manner as segments 26, 28 and 30 are secured to hinge plate 52 of the first embodiment shown in FIG. 5. However, in FIG. 7, lower segment 86 is shown as being longer than middle segment 84, which is longer than upper segment 82. Therefore, the ends of lower segment 86 are positioned farthest from band 78 while the ends of upper segment 82 are closest to band 78.

The upper segment 82 is preferably secured to the underside of bill 80. This may be accomplished in the same manner as for the first embodiment. For example, the upper segment 82 may be permanently secured to the underside of bill 80 by means of gluing. More preferably, upper segment 82 is detachably secured to the underside of bill 80. The bill 80 may have the lip on its underside (not shown) similar to lip 66 on lower jaw 24 of the first embodiment. As discussed above in relation to the first embodiment, the upper segment 82 may be similarly secured to a lip on the underside of bill 80 by means of a touch fastener or a magnetic mechanism.

Preferably, at least the middle segment 84 and lower segment 86 are pivotable about pivot pin 88. Preferably, upper segment 82 is detachably secured to the bill 80 and is also pivotable about pivot pin 88. Further, a stop mechanism may be attached to pivot pin 88 similar to that shown in FIG. 10, discussed below, in order to limit the extent to which each segment may pivot.

As shown in FIG. 8, middle segment 84 and lower segment 86 are preferably pivotable upwardly about pivot pin 88 so that they adopt the same position as upper segment 82, and are nested with upper segment 82.

As discussed above, middle segment 84 is slightly longer than upper segment 82 and lower segment 86 is slightly longer than middle segment 84. Therefore, when segments 84 and 86 are pivoted upwardly to adopt the position of upper segment 82, the longest segment 86 is positioned farthest from the wearer's face and the shortest segment 82 is closest to the wearer's face. The configuration shown in FIG. 8 can be used when the wearer 10 desires eye protection only.

In some cases, the wearer 10 may not desire any eye or face shielding at all. Therefore, as shown in FIG. 9, the segments 82, 84 and 86 are preferably pivotable in clockwise direction about pivot pin 88, to adopt a position wherein the three segments 82, 84 and 86 engage the top of the bill 80 and are nested one behind the other.

Figure 9:
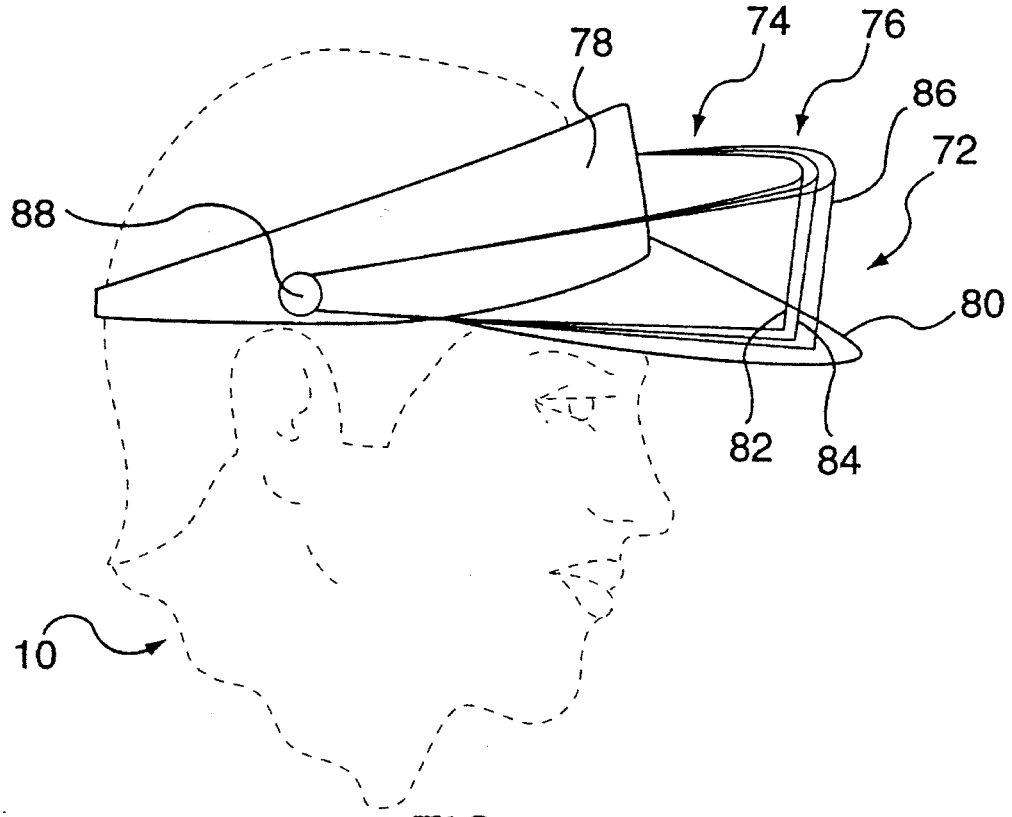
FIG. 9 is a side perspective view illustrating the face shield of FIG. 7 as worn by a wearer, with all three segments pivoted out of blocking relationship to the user's face.

In FIG. 9, segments 82, 84 and 86 are shown as having been rotated in the clockwise direction about pivot pin 88 and are resting on top of bill 80.

Alternatively, the pivot pin 88 may have a removable head which permits segments 82, 84 and 86 to be completely removed from the visor 74. Also, pivot pin 88 preferably has a decorative cap (not shown) which is colour coordinated with the visor 74.

Although the segments 26, 28 and 30 of the first embodiment are not pivotable to the upper surface of bill 14, it is to be understood that hinge plates 52 and 54 could be relocated to allow greater range of pivoting.

Figure 10:
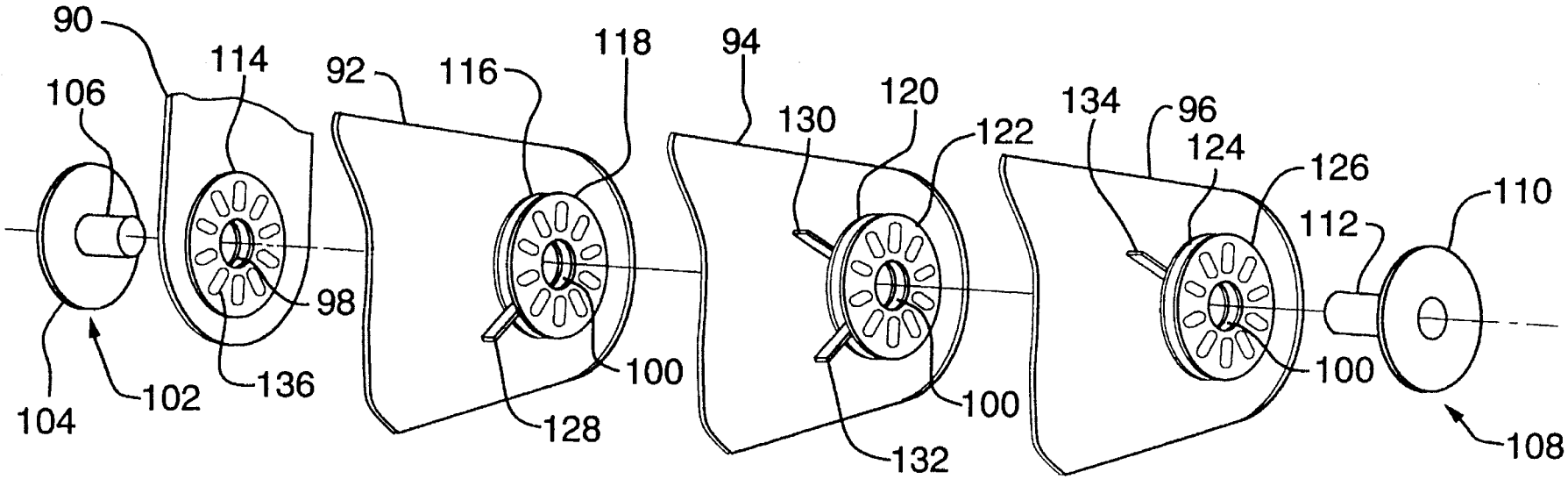
FIG. 10 is an exploded, perspective view, showing a preferred manner in which the segments may be pivotally secured to the left hinge plate in a face shield of the present invention.

FIG. 10 illustrates an alternate way in which segments of a shielding device may be attached to a hinge plate in a face shield similar to that shown in FIGS. 1 to 3, rather than the arrangement shown in FIG. 5. The arrangement shown in FIG. 10 may also be adapted to the second embodiment of FIGS. 7 to 9.

FIG. 10 illustrates a left hinge plate 90 of a face shield. Although not shown in FIG. 10, it is to be understood that left hinge plate 90 is connected to a securing mechanism similar to that shown in FIGS. 1 to 3. Also shown are upper segment 92, middle segment 94 and lower segment 96. FIG. 10 only illustrates the portions of segments 92, 94 and 96 adjacent the hinge plate 90. It is to be understood that segments 92, 94 and 96 have substantially the same shape as the segments shown in FIGS. 1 to 9.

The left hinge plate 90 is provided with a central hole 98. Similarly, each segment 92, 94 and 96 is provided with an end hole 100, the end holes 100 preferably being about the same size as the central hole 98 in the hinge plate 90.

FIG. 10 also illustrates a pivot pin assembly comprising an inner pivot pin segment 102 comprising a head 104 and a shaft 106, and an outer pivot pin segment 108 comprising a head 110 and shaft 112. The heads 104 and 110 have a diameter greater than the diameter of holes 98 and 100, whereas the shafts 106 and 112 have diameters which are preferably slightly less than the diameters of holes 98 and 100. This allows shafts 106 and 112 to extend through holes 98 and 100, but prevents the heads 104 and 110 from passing through holes 98 and 100.

One of the pivot pin segments 102 or 108 has a hollow shaft sized to receive the shaft of the other pivot pin segment. When the smaller shaft of one pin segment is slid into the hollow shaft of the other segment, a pivot pin is formed which retains segments 92, 94 and 96 in place relative to hinge plate 90 and permits pivoting of segments 92, 94 and 96 about the pivot pin.

The device shown in FIG. 10 is also provided with a ratcheting mechanism which prevents unwanted slippage of the segments 92, 94 and 96 relative to hinge plate 90 and to one another. To provide this ratcheting mechanism, the outward facing side of hinge plate 90 is provided with a disc 114 which surrounds hole 98 and has spaced semi-cylindrical bumps 136 extending radially from its centre. This disc 114 may be either secured to hinge plate 90, as by adhesive, or may be integrally formed as part of hinge plate 90.

Similarly, upper segment 92 is provided with a disc 116 on its inner side and a disc 118 on its outer side, discs 116 and 118 surrounding hole 100. These discs 116 and 118 preferably have substantially the same size and configuration of bumps 136 as previously described disc 114.

Similarly, middle segment 94 is provided with inner disc 120 and outer disc 122 and lower segment 96 is provided with inner disc 124 and outer disc 126. These discs 120, 122, 124 and 126 preferably have substantially the same size and configuration of bumps 136 as disc 114. Although not essential, it is preferred that the head 110 of pivot pin segment 108 also has a disc on its inward facing side which is similar to disc 114. However, this is not shown in FIG. 10.

When the face shield shown in FIG. 10 is assembled, the pivot pin preferably retains the segments 92, 94 and 96 in close engagement with one another, and in close engagement with the hinge plate 90. When the hinge plate 90 and segments 92, 94 and 96 are in close engagement with one another, the discs of adjacent plates will be in engagement with one another, and the bumps 136 of these plates will mesh with one another. The meshing of the bumps 136 allows the user of the face shield to pivot the segments relative to one another, but substantially prevents slippage of the segments 92, 94 and 96 from their desired positions.

The embodiment shown in FIG. 10 also incorporates stop mechanisms which limit the degree to which the segments 92, 94 and 96 may pivot. As shown in FIG. 10, the outer disc 118 of upper segment 92 is provided with a stop 128 which engages a corresponding stop 130 on inner disc 120 of middle segment 94, when middle segment 94 is rotated downwardly relative to upper segment 92. This stop mechanism preferably prevents pivoting of middle segment 94 below the position shown in FIG. 7. Similarly, outer disc 122 of middle segment 94 is provided with a stop 132 and inner disc 124 of lower segment 96 is provided with a corresponding stop 134. The stops 132 and 134 engage one another when lower segment 96 is pivoted downwardly relative to middle segment 94. The stop mechanism preferably prevents lower segment 96 from pivoting downward relative to middle segment 94 past the position shown in FIG. 7.

Figure 11:
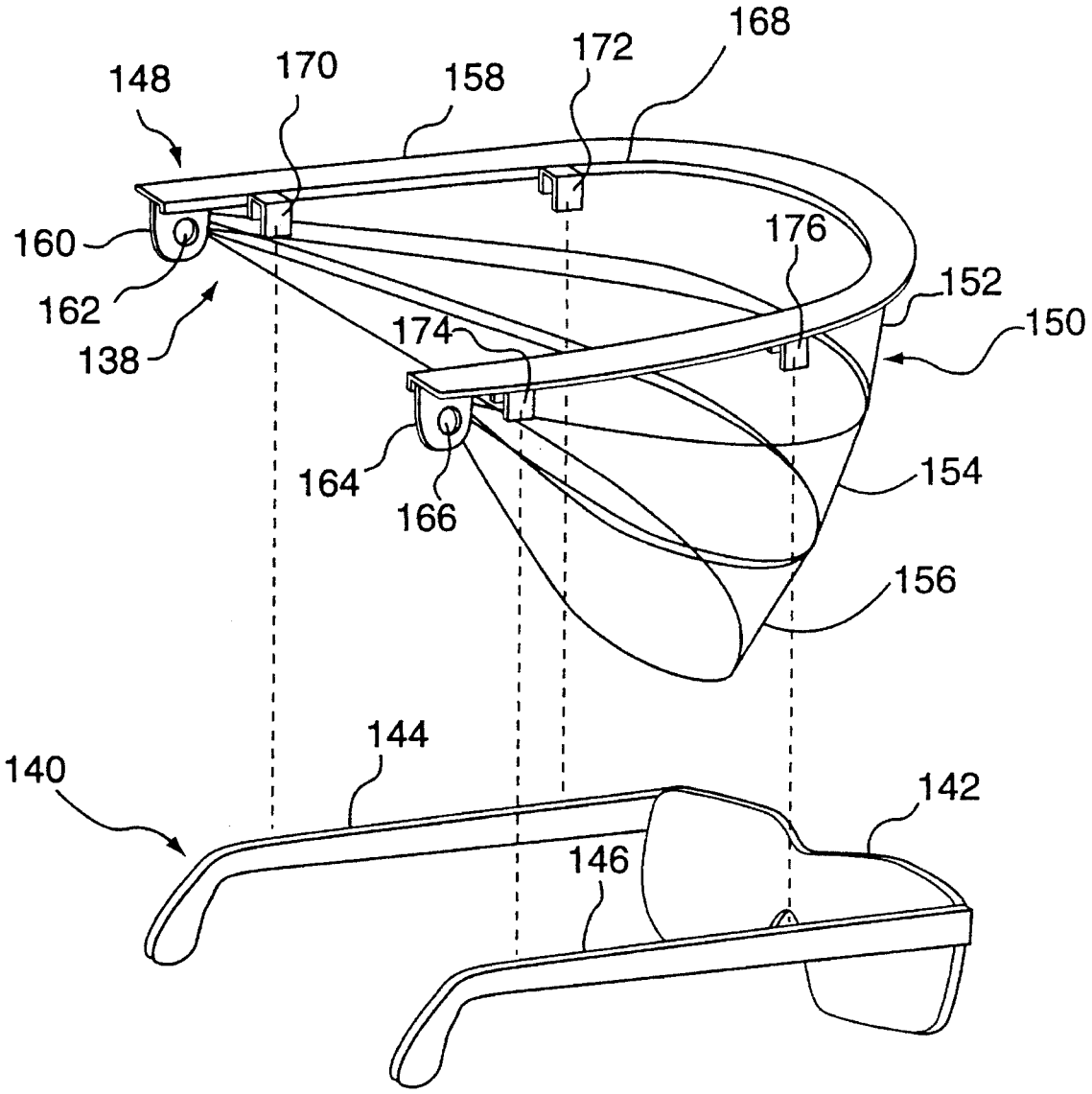
FIG. 11 is a side perspective view illustrating a third preferred embodiment of the face shield of the present invention, showing the manner in which the face shield may be attached to a pair of eyeglasses.
Figure 12:
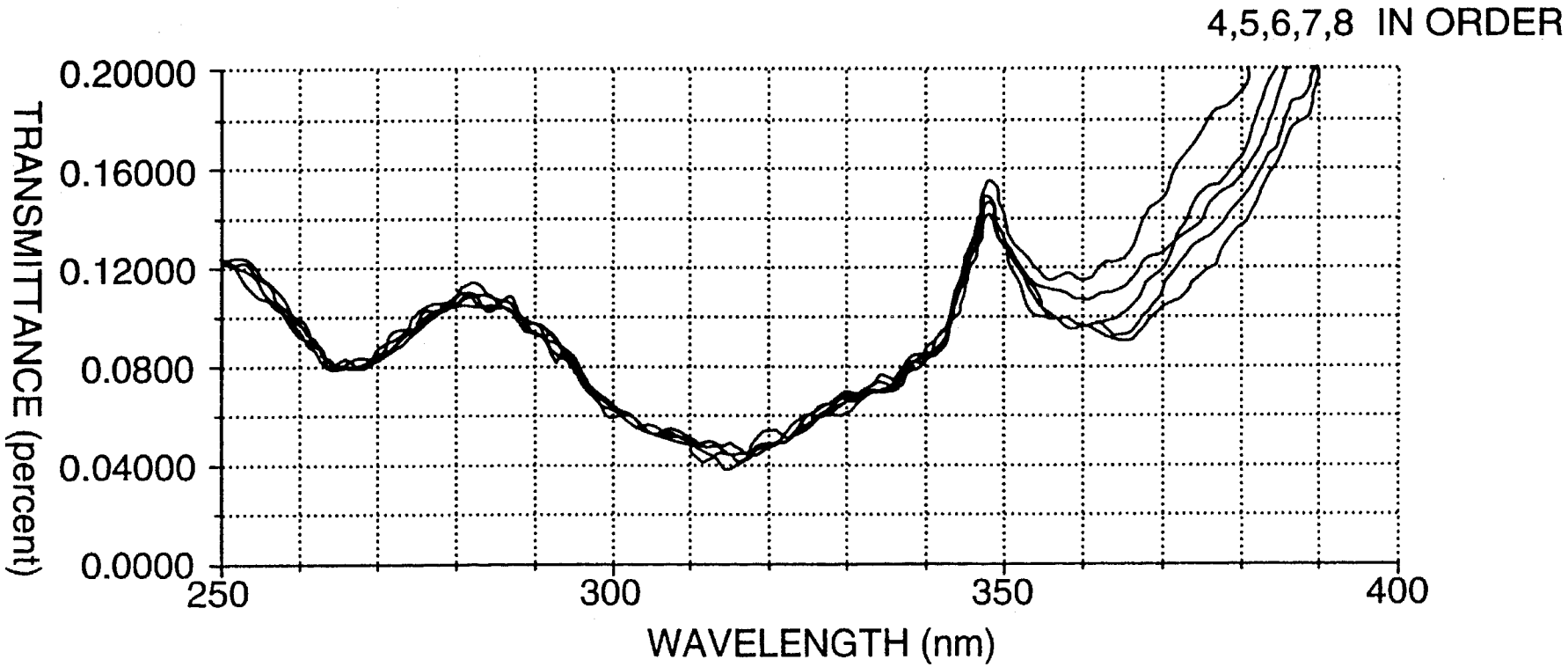
FIGS. 12 to 17 are plots of transmittance versus wavelength for various shielding materials.
Figure 13:
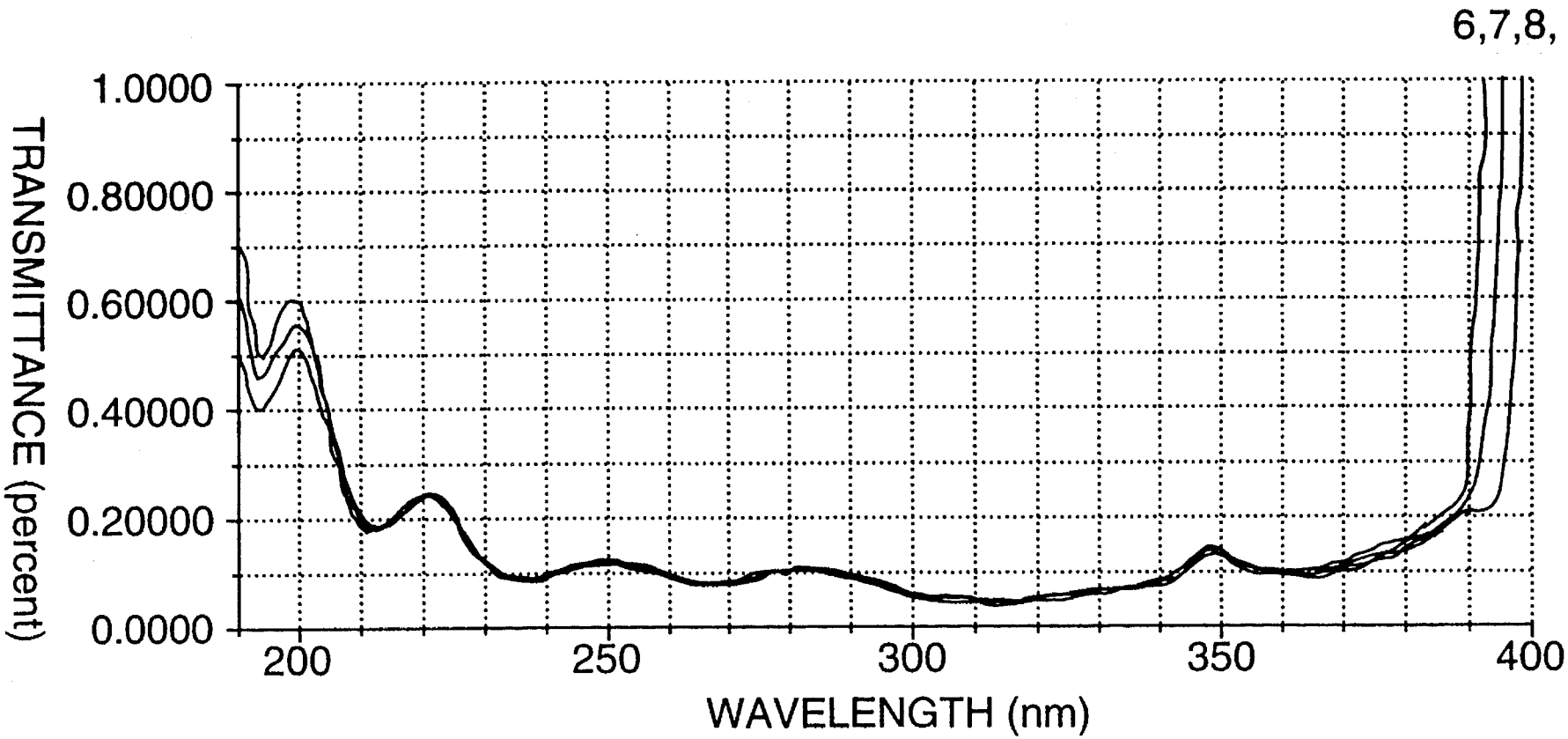
Figure 14:
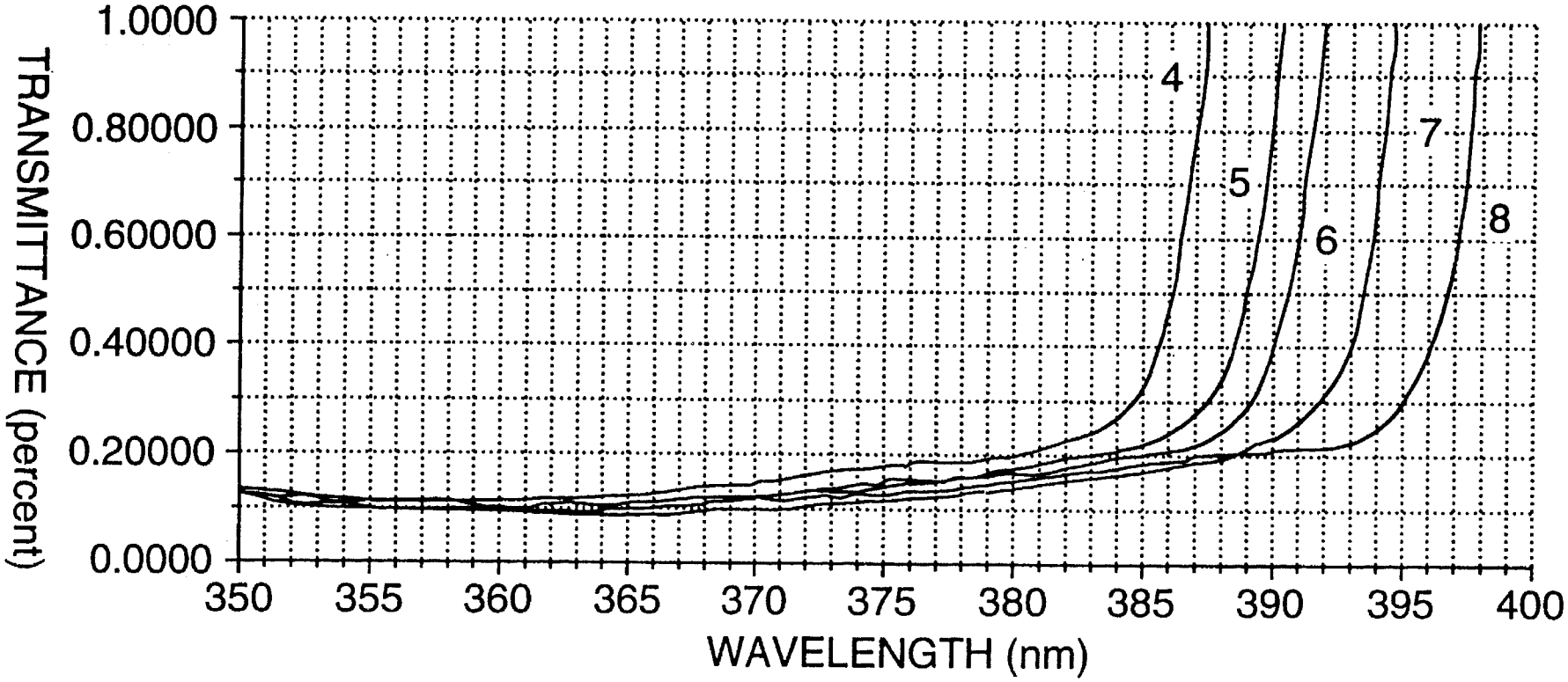
Figure 15:
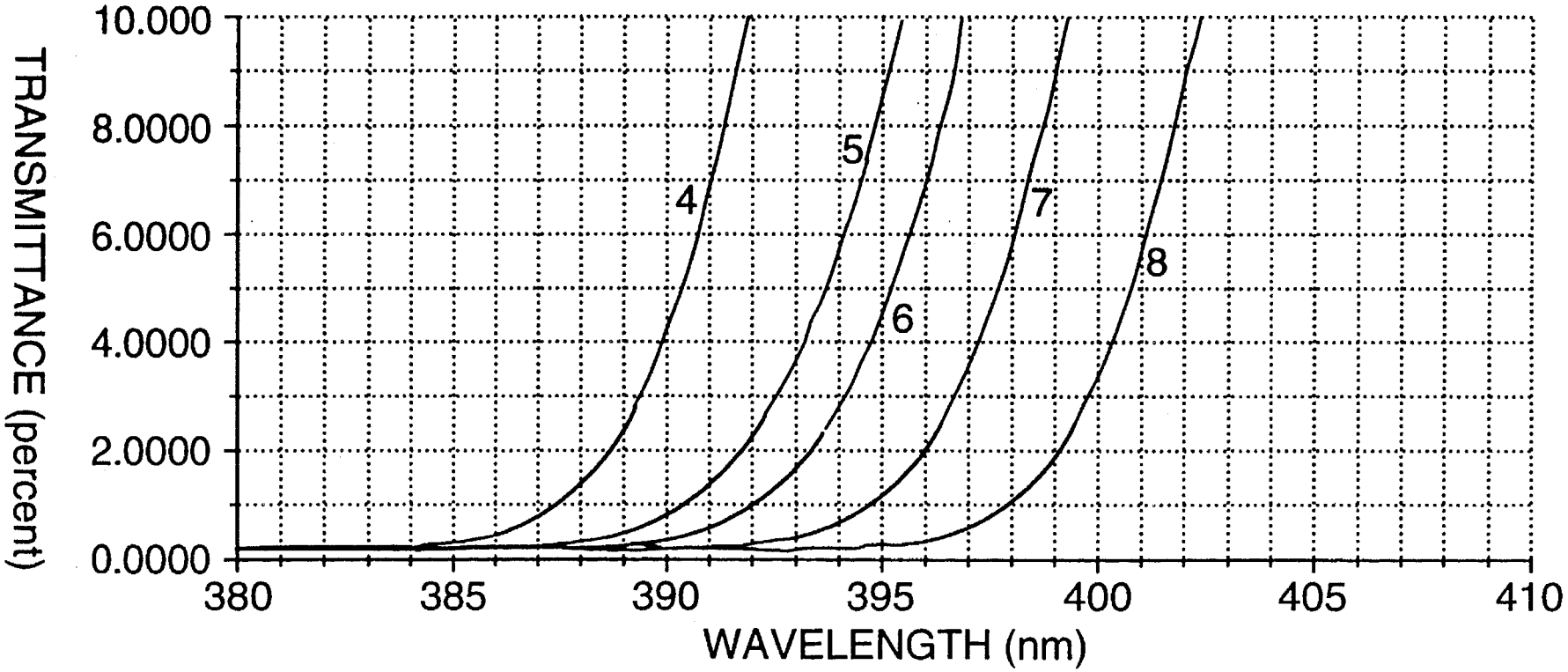
Figure 16:
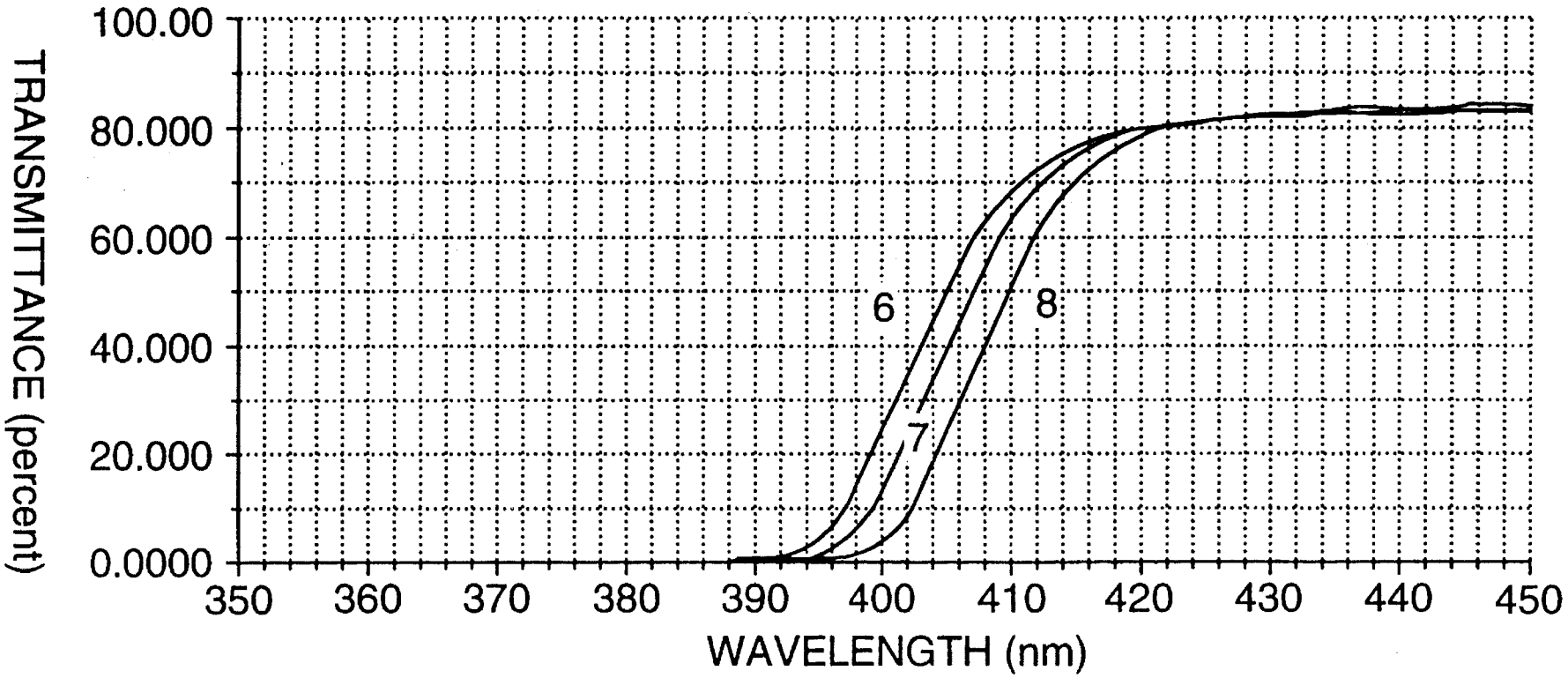
Figure 17:
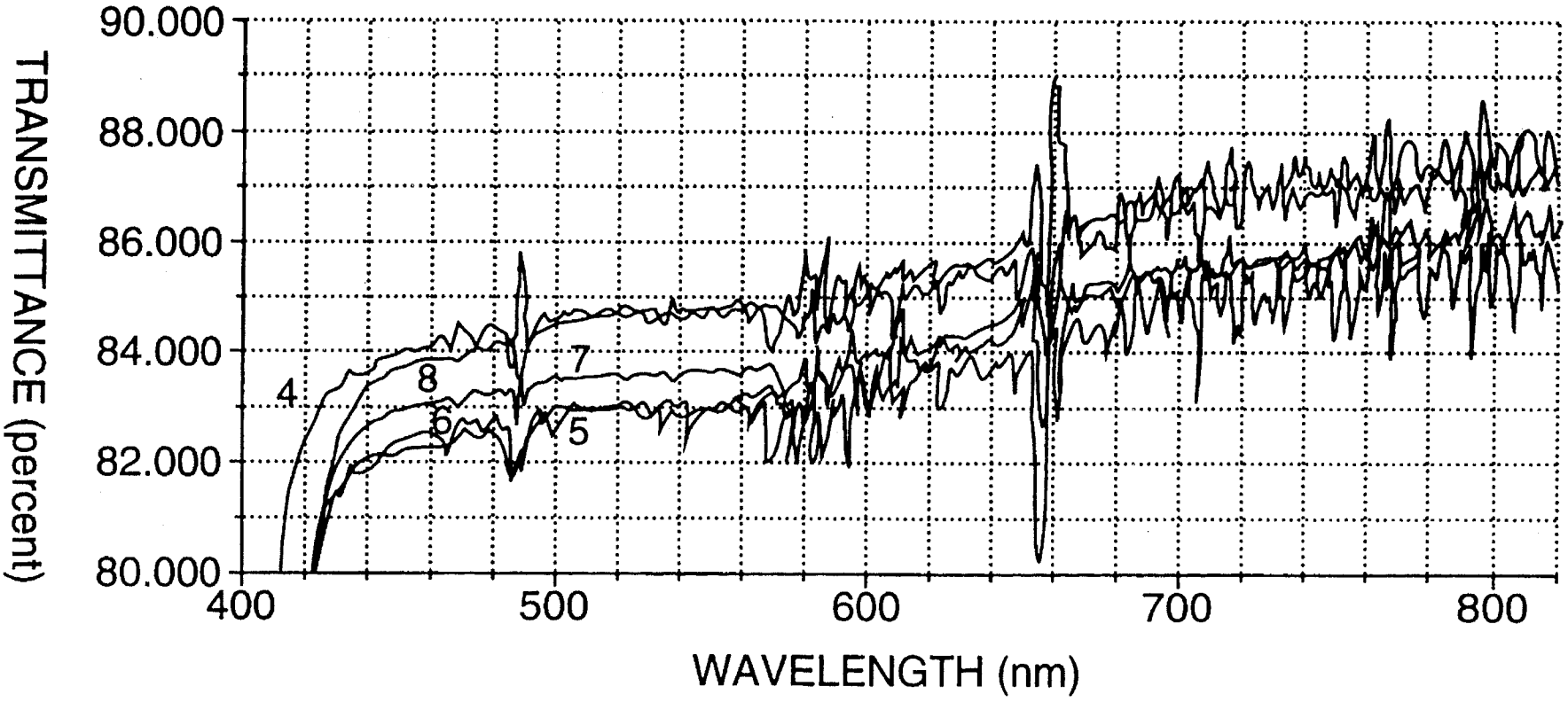

A third embodiment of a face shield according to the present invention is illustrated in FIG. 11. In this embodiment, face shield 138 is releasably mounted on a pair of eyeglasses 140, comprising a pair of lenses 142, a left leg 144 and a right leg 146. The eyeglasses are preferably conventional prescription and/or sunglasses which are normally worn by the user.

Face shield 138 of this third embodiment comprises a securing mechanism 148 and shielding device 150. The shielding device 150 shown in FIG. 11 is substantially identical to that shown in FIGS. 1 to 3, comprising an upper segment 152, a middle segment 154 and a lower segment 156.

The securing mechanism 148 comprises a flat, arcuate portion 158 which is similar in size and shape to the lower jaw 24 of the first embodiment shown in FIGS. 1 to 3. Extending downwardly from the left rear end of the flat, arcuate portion 158 is a left hinge plate 160 having a central hole 162. Similarly, extending downwardly from the right rear end of arcuate portion 158 is a right hinge plate 164 having a central hole 166. Although not clearly shown in FIG. 11, the segments 152, 154 and 156 are preferably pivotably connected to the hinge plates 160 and 164 by any of the means discussed above in reference to other embodiments of the invention.

The flat, arcuate portion 158 has an inner edge 168 extending about its inner periphery. Attached to the left portion of the inner edge are retaining clips 170 and 172, and attached to the right side of the inner edge are retaining clips 174 and 176.

As shown by the dotted lines in FIG. 11, the face shield 138 is mounted on the eyeglasses 140 by sliding retaining clips 170 and 172 over the left leg 144 of the eyeglasses 140 and sliding retaining clips 174 and 176 over the right leg 146 of the eyeglasses 140. Preferably, the clips 170, 172, 174 and 176 fit tightly over legs 144 and 146 in order to tightly retain the face shield 138 on the eyeglasses 140.

When in use, both the user's face and the eyeglasses 140 are behind the shielding device 150. Therefore, the user may comfortably wear his or her eyeglasses 140 underneath the face shield of the present invention, with no additional headgear being required.

EXAMPLES

In the following examples, various shielding materials were prepared and tested for transmittance of ultraviolet radiation.

EXAMPLE 1.

A polycarbonate host of 1.00 mm thickness was prepared having the following composition:

| | |
|---|---|
| B 225 IRGANOX | 0.1 weight % |
| PEP-Q SANDOSTAB | 0.1 weight % |
| G62 PARAPLEX | 0.15 weight % |
| TINUVIN P | 0.3 weight % |
| TINUVIN 328 | 0.3 weight % |
| TINUVIN 770 | 0.2 weight % |

mixed in Polycarbonate 2658. The host was found to be capable of blocking 99.5% of UV-A radiation (320 nm to 400 nm) and UV-B radiation (290 nm to 320 nm) and is equivalent to an SPF of 100.

EXAMPLE 2.

A polycarbonate host of 0.30 mm thickness with the same formulation as in Example 1 was found capable of blocking 97% of the UV-A and UV-B radiation rendering an SPF of 35.

EXAMPLE 3.

A polycarbonate host of 0.50 mm thickness containing the same formulation as Example 1 was found capable of blocking 98% of UV-A and UV-B radiation rendering an SPF of nearly 50.

EXAMPLES 4–8.

Polycarbonate hosts having formulations different from that of Example 1 and having a thickness of 1.0 mm were tested for transmittance of UV-A and UV-B radiation. The results of these tests are shown in FIGS. 12 to 17, which are plots of transmittance versus wavelength for examples 4 to 8.

Composition of Example 4:

| | |
|---|---|
| Polycarbonate 2658 | 99.3 weight % |
| TINUVIN P | 0.3 weight % |
| CYASORB UV5411 | 0.2 weight % |
| DISPERSAL | 0.1 weight % |
| B 225 IRGANOX | 0.1 weight % |

Composition of Example 5:

| | |
|---|---|
| Polycarbonate 2658 | 99.1 weight % |
| TINUVIN P | 0.3 weight % |
| UVAROL 311 | 0.3 weight % |
| B 225 IRGANOX | 0.1 weight % |
| PEP Q SANDOSTAB | 0.1 weight % |
| A280 Wax | 0.1 weight % |

The composition of Example 7 is identical to that of Example 1. Examples 6 and 8 contain the same ingredients as Example 1 in different amounts.

Example 9

The transmittance of a host having the following composition and a thickness of 0.3 mm was tested.

| | |
|---|---|
| Polycarbonate 2658 | 96.2 weight % |
| B 225 IRGANOX | 0.33 weight % |
| PEP Q SANDOSTAB | 0.33 weight % |
| G62 PARAPLEX | 0.50 weight % |
| TINUVIN P | 1.0 weight % |
| TINUVIN 328 | 1.0 weight % |
| TINUVIN 770 | 0.67 weight % |

The composition of Example 9 was found to have an SPF of 100.

Although the invention has been described in connection with certain preferred embodiments, it is not intended that it be limited thereto. Rather, it is intended that the invention cover all alternate embodiments as may be within the scope of the following claims.

We claim:

1. A headgear mountable protective face shield to substantially completely cover a wearer's face and protect the face from exposure to ultraviolet radiation, said face shield comprising:

first hinge means to be positioned outwardly of a first side of the wearer's head;

second hinge means to be positioned outwardly of a second side of the wearer's head;

articulated shielding means comprising an upper segment, a middle segment, and a lower segment, each segment being curved and elongated and extending across the wearer's face, each segment having a first end secured to the first hinge means and a second end secured to the second hinge means, the upper segment being in frontal blocking relationship to the eyes of the wearer; and means to secure the hinge means to an article of headgear to be worn by the wearer;

at least said middle and lower segments of the shielding means being pivotable about a pivot axis extending through the first and second hinge means;

the shielding means preventing at least some ultraviolet radiation from reaching the wearer's face.

2. The face shield of claim 1, wherein the securing means detachably secures the hinge means to the headgear.

3. The face shield of claim 1, wherein the upper segment is at least partially transmissive of visible radiation.

4. The face shield of claim 1, wherein the upper segment is provided with ventilation holes.

5. The face shield of claim 1, wherein the securing means secures the face shield to an outwardly projecting brim of an article of headgear, said brim having an upper surface and a lower surface.

6. The face shield of claim 5, wherein the securing means comprises an upper jaw means to engage the upper surface of the brim and a lower jaw means to engage the lower surface of the brim, the upper and lower jaw means being biased together to retain the brim of the headgear therebetween.

7. The face shield of claim 6, wherein the hinge means are carried by the lower jaw means.

8. The face shield of claim 1, wherein the securing means secures the face shield to a bill forming part of an article of headgear and projecting forwardly of the user's head, said bill having an upper surface, a lower surface, and an outer periphery.

9. The face shield of claim 8, wherein the securing means comprises an upper jaw means to engage the outer periphery on the upper surface of the bill and a lower jaw means to engage the outer periphery on the lower surface of the bill, the upper and lower jaw means being biased together to retain the bill of the headgear therebetween.

10. The face shield of claim 1, wherein the shielding means has a sun protection factor of from about 15 to about 100.

11. The face shield of claim 10, wherein the shielding means has a sun protection factor of from about 50 to about 100.

12. The face shield of claim 11, wherein the shielding means has a sun protection factor of from about 90 to about 100.

13. The face shield of claim 1, wherein the shielding means comprises a polycarbonate base containing additives which absorb ultraviolet radiation and has a thickness of from about 0.1 mm to about 2.0 mm.

14. The face shield of claim 1, wherein the article of headgear is a pair of eyeglasses.

15. A headgear mountable protective face shield to substantially completely cover a wearer's face and protect the face from exposure to ultraviolet radiation, said face shield comprising:

first hinge means to be positioned outwardly of a first side of the wearer's head;

second hinge means to be positioned outwardly of a second side of the wearer's head;

articulated shielding means comprising a plurality of curved, elongated segments, each segment extending across the wearer's face and having a first end secured to the first hinge means and a second end secured to the second hinge means; and means to secure the hinge means to an article of headgear to be worn by the wearer;

at least one of said segments of the shielding means being pivotable about a pivot axis extending through the first and second hinge means;

the shielding means preventing at least some ultraviolet radiation from reaching the wearer's face;

said securing means securing the face shield to a bill forming part of said article of headgear and projecting forwardly of the wearer's head, said bill having an upper surface, a lower surface and an outer periphery;

said securing means comprising an upper jaw means to engage the outer periphery on the upper surface of the bill and a lower jaw means to engage the outer periphery on the lower surface of the bill, the upper and lower jaw means being biased together to retain the bill of the headgear therebetween;

said upper and lower jaw means being U-shaped and each having two rearwardly extending legs joined to a forward portion, the hinge means being carried on the rearwardly extending legs of the lower jaw means.

16. The face shield of claim 15, wherein the upper and lower jaw means are pivotable about a substantially horizontal axis between said forward portions of said upper and lower jaw means.

17. The face shield of claim 16, wherein clamping means are provided adjacent terminal ends of the rearwardly extending legs of the jaw means to bias the upper jaw means and the lower jaw means together.

18. The face shield of claim 17, wherein:

the shielding means comprises an upper segment, a middle segment and a lower segment; the upper segment being in frontal blocking relationship to the eyes of the wearer; the middle segment and the lower segment being independently pivotable about the pivot axis;

the upper segment having an upper edge detachably secured to the lower jaw means adjacent the forward edge of the lower jaw means; and, when detached from the lower jaw, the upper segment is independently pivotable about the pivot axis.

* * * * *

UNITED STATES PATENT AND TRADEMARK OFFICE

CERTIFICATE OF CORRECTION

PATENT NO. :5,544,361
DATED :Aug. 13, 1996
INVENTOR(S) :Wendy J. Fine, et al

It is certified that error appears in the above-identified patent and that said Letters Patent is hereby corrected as shown below:

The title page, showing the illustrative figures, should be deleted and substitute therefor the attached title page.

Signed and Sealed this

FourthDay of August, 1998

Bruce Lehman

*Attest:*

BRUCE LEHMAN

*Attesting Officer*

*Commissioner of Patents and Trademarks*

United States Patent [19]

Fine et al.

[11] Patent Number: 5,544,361

[45] Date of Patent: Aug. 13, 1996

[54] HEADGEAR MOUNTABLE PROTECTIVE FACE SHIELD

[75] Inventors: Wendy J. Fine, Coral Springs, Fla.; Gary A. Davidson, 6985 N.W. 29th Ter., Fort Lauderdale, Fla. 33309; Alexander Rykman, 6285 Island Way, Margate, Fla. 33063

[73] Assignees: Gary A. Davidson, Fort Lauderdale; Alexander Rykman, Margate, both of Fla.

[21] Appl. No.: 374,886

[22] Filed: Jan. 19, 1995

[51] Int. Cl.[6] ..... A42B 1/06; G02C 7/16

[52] U.S. Cl. ..... 2/10; 2/454; 351/57; 351/155

[58] Field of Search ..... 2/424, 15, 10, 2/11, 12, 13, 9, 454, 453; 351/155, 158, 57, 58, 59

[56] References Cited

U.S. PATENT DOCUMENTS

| | | | |
|---|---|---|---|
| 1,176,313 | 3/1916 | Pfund . | |
| 1,238,154 | 8/1917 | Kemp . | |
| 1,298,223 | 3/1919 | Kemp . | |
| 2,360,482 | 10/1944 | Evans | 2/12 |
| 3,030,628 | 4/1962 | Crosson . | |
| 3,521,629 | 7/1970 | Reynolds . | |
| 3,780,379 | 12/1973 | Kampman | 2/15 |
| 3,868,727 | 3/1975 | Paschall | 2/8 |
| 4,726,074 | 2/1988 | Bacht et al. | 2/10 |
| 4,758,079 | 7/1988 | Bledsoe | 351/44 |
| 4,870,959 | 10/1989 | Reisman et al. | 128/201.25 |
| 5,066,082 | 11/1991 | Longstaff | 359/361 |
| 5,105,475 | 4/1992 | Lynd et al. | 2/10 |
| 5,113,535 | 5/1992 | Hedges et al. | 2/424 |
| 5,208,916 | 5/1993 | Kelman | 2/10 |
| 5,261,124 | 11/1993 | Day | 2/453 |
| 5,329,642 | 7/1994 | Dampney | 2/424 |

FOREIGN PATENT DOCUMENTS

| | | | |
|---|---|---|---|
| 2532528 | 3/1984 | France | 2/424 |
| 1299559 | 3/1987 | U.S.S.R. | 2/424 |

OTHER PUBLICATIONS

Bolle America, Inc., "Sun and Sport Eyewear Buyer's Guide 1994" ( cover and page 7).

Council on Scientific Affairs, "Harmful Effects of Ultraviolet Radiation", JAMA, Jul. 21, 1989–vol. 262, No. 3.

Boyce Rensberger, "Ultraviolet Spectrum's Long Rays May Cause Malignant Melanoma", Washington Post, Jul. 23, 1993, p. 15.

National Institute of Arthritis and Musculoskeletal and Skin Diseases, "Sun and Skin" Jul. 1992.

National Institutes of Health, "Sunlight, Ultraviolet Radiation and the Skin", Consensus Development Conference Statement, vol. 7, No. 8, May 8–10, 1989.

*Primary Examiner*—Michael A. Neas

*Attorney, Agent, or Firm*—Mallinckrodt & Mallinckrodt

[57] ABSTRACT

The present invention provides a lightweight headgear mountable protective face shield capable of protecting substantially the entire face of a human wearer from ultraviolet radiation. The face shield comprises an articulated shielding arrangement to be positioned in blocking relationship to the wearer's face. The shielding arrangement comprising a plurality of segments extending across the wearer's face, the ends of which are preferably pivotally connected to hinge plates positioned at either side of the wearer's head. The hinge plates are attached to a securing mechanism which secures the face shield to an article of headgear. In a preferred embodiment, the face shield is detachably secured to the forwardly projecting bill of a baseball style cap by a securing mechanism comprising a pair of jaws between which the bill is secured by clamping.

18 Claims, 14 Drawing Sheets

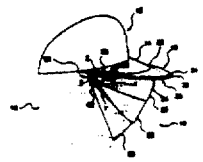

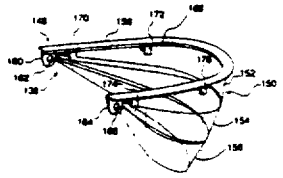

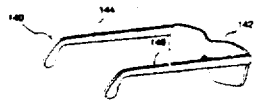

UNITED STATES PATENT AND TRADEMARK OFFICE

CERTIFICATE OF CORRECTION

PATENT NO. : 5,544,361

DATED : August 13, 1996

INVENTOR(S) : Fine, et al.

It is certified that error appears in the above-identified patent and that said Letters Patent is hereby corrected as shown below:

The Assignee should be shown as --Wendy J. Fine, Coral Springs, Fla.--

Fig. 1 should be as follows:

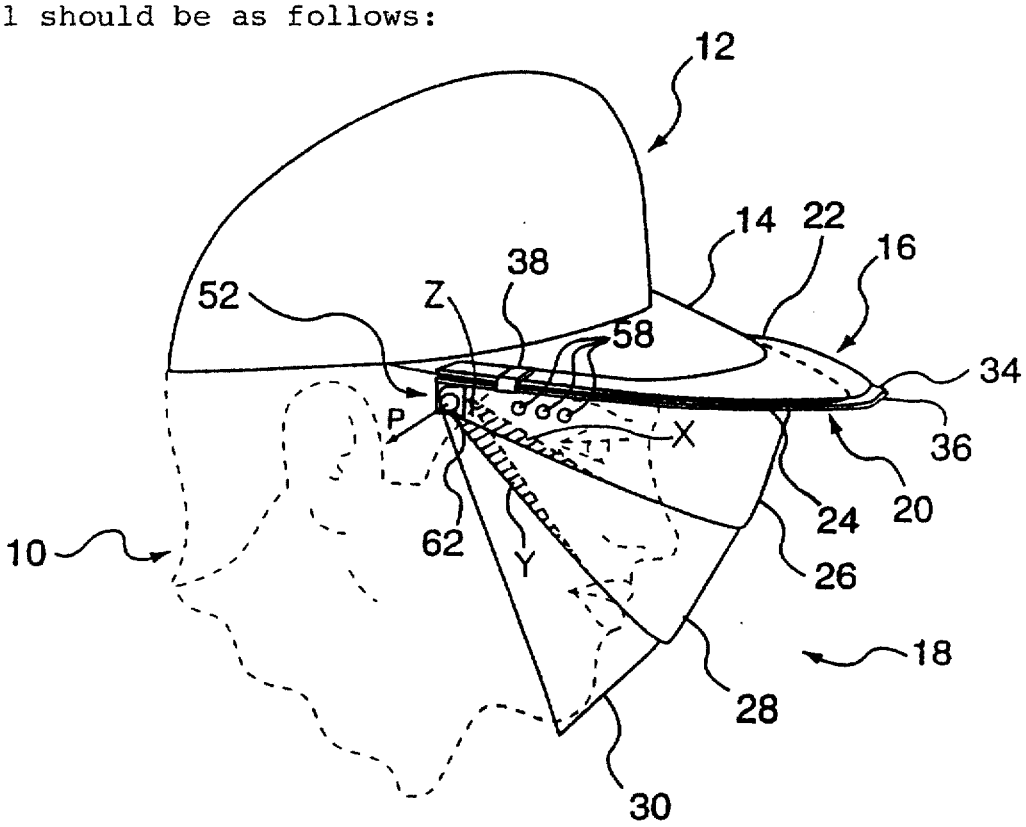

FIG. 1

UNITED STATES PATENT AND TRADEMARK OFFICE

CERTIFICATE OF CORRECTION

PATENT NO. : 5,544,361

DATED : August 13, 1996

INVENTOR(S) : Fine, et al.

It is certified that error appears in the above-identified patent and that said Letters Patent is hereby corrected as shown below:

Fig. 3 should be as follows:

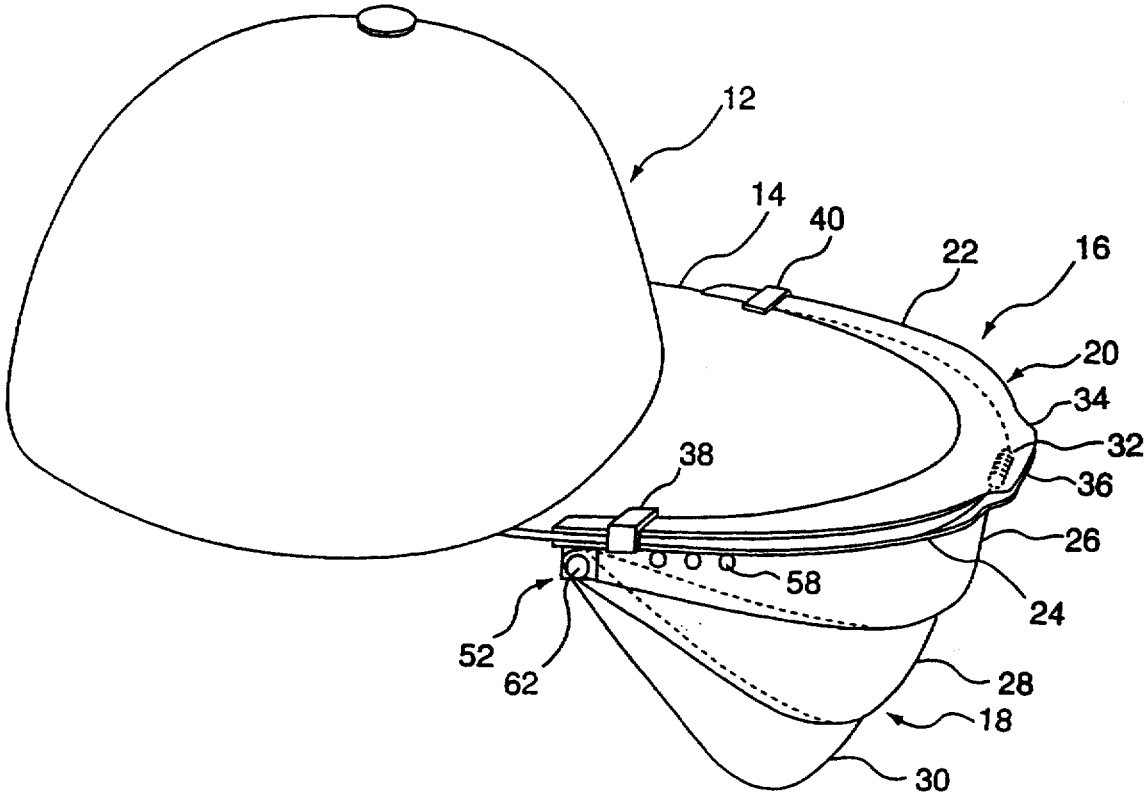

FIG. 3